US005836582A

United States Patent [19]

Ogawa et al.

[11] Patent Number: 5,836,582

[45] Date of Patent: Nov. 17, 1998

[54] SHEET FEEDING DEVICE WITH AIR INJECTORS FOR SEPARATING SHEETS

[75] Inventors: Hiroshi Ogawa, Yokohama; Michiro Koike, Kawasaki; Yoshimitsu Nakane, Chigasaki, all of Japan

[73] Assignee: Canon Kabushiki Kaisha, Tokyo, Japan

[21] Appl. No.: 919,350

[22] Filed: Aug. 28, 1997

Related U.S. Application Data

[63] Continuation of Ser. No. 412,317, Mar. 29, 1995, abandoned.

[30] Foreign Application Priority Data

Apr. 4, 1994 [JP] Japan ..... 6-089101
Jul. 29, 1994 [JP] Japan ..... 6-197478

[51] Int. Cl.[6] ..... B65H 5/08

[52] U.S. Cl. ..... 271/12; 271/171; 271/98; 271/99; 271/105

[58] Field of Search ..... 271/11–12, 97, 271/98, 99, 104–106, 171, 13

[56] References Cited

U.S. PATENT DOCUMENTS

| | | | |
|---|---|---|---|
| 1,493,167 | 5/1924 | Stevens | 271/105 X |
| 2,806,696 | 9/1957 | Bishop | 271/99 X |
| 2,812,178 | 11/1957 | Hagren | 271/104 X |
| 3,099,442 | 7/1963 | Wendricks et al. | 271/97 |
| 3,198,514 | 8/1965 | Barbera et al. | 271/12 |
| 3,198,524 | 8/1965 | Ringstad . | |
| 3,595,563 | 7/1971 | Rostoker et al. | 271/105 X |
| 3,684,276 | 8/1972 | Bridgeman | 271/106 X |
| 4,418,905 | 12/1983 | Garavuso | 271/98 |
| 5,092,578 | 3/1992 | Bergmeier et al. | 271/98 X |
| 5,110,110 | 5/1992 | Wirz et al. | 271/97 X |
| 5,181,711 | 1/1993 | Spoorenberg | 271/98 |
| 5,184,812 | 2/1993 | Namba | 271/98 |
| 5,478,066 | 12/1995 | Yoshida et al. | 271/99 X |

FOREIGN PATENT DOCUMENTS

| | | | |
|---|---|---|---|
| 58-8932 | 1/1983 | Japan . | |
| 58-78932 | 5/1983 | Japan . | |
| 116034 | 4/1992 | Japan | 271/98 |

*Primary Examiner*—Boris Milef
*Attorney, Agent, or Firm*—Fitzpatrick, Cella, Harper & Scinto

[57] ABSTRACT

Air injection nozzles are provided for injecting air to both the leading end and the side ends of the sheets loaded on a sheet tray. Since air is injected from both nozzles, even for large-size sheets, the sheets can securely be separated by injecting air over the whole region between a sheet to be conveyed and other sheets.

14 Claims, 22 Drawing Sheets

SHEET FEEDING DEVICE WITH AIR INJECTORS FOR SEPARATING SHEETS

This application is a continuation of application No. 08/412,317, filed Mar. 29, 1995, now abandoned.

BACKGROUND OF THE INVENTION

1. Field of the Invention

The present invention relates to a sheet feeding device for separating and feeding, one by one, sheets such as loaded originals, recording sheets, etc. in an image forming apparatus such as a copying machine.

2. Related Background Art

An image forming apparatus such as a copying machine or a printing or photographic printing apparatus is often provided with a cyclic automatic original feeding device (RDH) in which loaded originals are supplied one by one from the top or bottom thereof, and are then returned to the top or bottom at the loading position after reading the supplied originals. The image forming apparatus may also be provided with a sheet feeding device for separating and feeding, one by one, sheets such as loaded originals or recording sheets.

Such a feeding device may contain, as a means for separating sheets one by one, a separation device utilizing air injection, a separation device utilizing separation claws, a separation device utilizing a roller which is rotated in a direction reverse to the feeding direction, or the like.

Examples of conventional feeding devices comprising a separation means utilizing air injection among the above separation means include a sheet feeding device disclosed in Japanese Patent Laid-Open No. 58-78932, and a similar device disclosed in U.S. Pat. No. 3,198,514.

FIG. 23 is a sectional side view illustrating the construction of an example of conventional feeding devices, and FIG. 24 is a plane view of the same example. FIG. 25 is a perspective view of a support tray 503 in the conventional feeding device of FIGS. 23 and 24 on which recording sheets S are loaded.

As illustrated in the drawings, the feeding device has a notch 504 formed at the center of an end of the support tray 503 on the downstream side in the feeding direction G. A feeding belt 507 which extends on a pair of rollers 505 and 506 below the support tray 503, and which has many through holes, is exposed from the notch 504. An air intake duct 508 which faces notch 504 with the feeding belt 507 therebetween is disposed between the rollers 505 and 506 so that the bottom sheet of the recording sheets S on the support tray 503 adheres to the feeding belt 507 under vacuum and is supplied by traveling the feeding belt 507.

On the other hand, plural sheets of the recording sheets S on the support tray 503 might be simultaneously adhered to the feeding belt 507 and be supplied together. Thus, an air injection duct 509 is provided above the support tray 503 on the downstream side in the feeding direction G so as to separate only the bottom sheet from the other sheets by injecting air concentrated on the leading ends of the recording sheets. Air is injected from nozzles 510*b* to 510*e*, which are parallel to the feeding direction G, and nozzles 510*a* and 510*f*, both of which are directed toward the center of the support tray 503. All nozzles are provided on the air injection duct 509. The air flow from the air injection duct 509 has a distribution as shown by a shadowed portion in FIG. 26 with respect to the recording sheets S.

In order to facilitate separation of the recording sheets S one by one, the support tray 503 has a base 514 which is notched at the end thereof on the downstream side in the feeding direction G, and side wings 515 and 516 which are formed at both widthwise sides of the base 514 and which are inclined upwardly.

In the sheet feeding device constructed as described above, large-size recording sheets such as A3 or A4 sheets are loaded on the support tray 503 and supplied in such a manner that the long sides thereof are at right angles to the feeding direction. Namely, such large-size recording sheets can sufficiently be separated by so-called transverse feeding. However, the transverse feeding of large-size sheets significantly increases the depth of the feeding device and brings about the need for a large photosensitive drum and large fixing rollers for forming images on the recording sheets.

In the above conventional feeding device, therefore, when large-size recording sheets are longitudinally placed on the support tray 503 and fed, hardly any of the air injected from the nozzle 510 reaches the trailing ends of the recording sheets, and no gap is thus formed between the bottom sheet and the other recording sheets at the rear thereof by an air flow. As a result, a plurality of sheets are fed at a time due to frictional force within the rear adhesion region of the recording sheets.

In this case, a conceivable means for causing the air flow to reach the trailing ends of large-size recording sheets is to increase the pressure and flowrate of the air flow from the nozzle 510 of the air injection duct 509. However, since the blade size and rotational speed of a blower for generating the air flow are increased as the pressure and flowrate of the air flow are increased, a problem of large noise occurs.

Further, the pressure and flowrate of the air flow sufficient to cause the air flow to reach the trailing ends of large-size recording sheets are excessive for small-size recording sheets, thereby disturbing the alignment of small-size recording sheets and adversely causing poor feeding.

Particularly, when the number of the recording sheets on the support tray 503 is gradually decreased, the alignment of the recording sheets is significantly disturbed. This causes a more critical problem of lightweight thin sheets and small-size sheets among the recording sheets used. A measure for avoiding the problem has already been proposed in which the air flow is adjusted by a valve provided on the air injection duct 509 in accordance with the size and weight of the recording sheets used, or the number of the sheets loaded. In this measure, however, since the flowrate and pressure of the air flow are set so as to cause the air flow to reach the trailing ends of large-size recording sheets which are longitudinally placed, the flowrate and pressure of the air flow are significantly increased.

Thus, the air flow cannot be finely adjusted by the valve so as to operate properly for the most difficult case such as a case where a small number of small-size thin sheets are loaded. Even if such fine adjustment is possible, a mechanism for achieving the fine adjustment is inevitably complicated, thereby adversely deteriorating the reliability of the whole feeding device.

SUMMARY OF THE INVENTION

An object of the present invention is to prevent a poor separation of sheets by allowing air for separating sheets to secularly reach the trailing ends of the sheets even in a case of large-size sheets.

In order to achieve the object, in accordance with an embodiment of the present invention, there is provided a sheet feeding device comprising sheet supporting means for supporting sheets, sheet feeding means for feeding the sheets supported by the sheet supporting means, and an air injection means for injecting air toward the ends of the sheets supported by the sheet supporting means so as to separate the sheets one by one. The lowermost sheet adheres to the sheet feeding means by air suction, and the air injection means comprises a first air injection member for injecting air toward the leading ends of the sheets supported by the sheet supporting means in the feeding direction thereof, and a second air injection member for injecting air toward the side ends of the sheets.

In accordance with another embodiment of the present invention, there is provided a sheet feeding device comprising sheet supporting means, sheet feeding means for feeding, with air suction for maintaining sheet adherence, the sheets supported by the sheet supporting means, and air injection means for injecting air toward ends of the sheets supported by the sheet supporting means so as to separate one of the sheets, which is near the sheet feeding means. The sheet supporting means has a sheet supporting member which is disposed at a predetermined height above a surface for supporting the sheets and which can partially support the sheets, the sheet supporting member being provided so as be movable between a support position where the sheets are supported and a retracted position where the sheets are not supported.

BRIEF DESCRIPTION OF THE DRAWINGS

FIG. 4 is a sectional view taken along line III—III of

FIG. 1, illustrating a state where large-size sheets are loaded;

DETAILED DESCRIPTION OF THE PREFERRED EMBODIMENTS

Embodiments of the present invention are described below with reference to the drawings.

(First Embodiment)

Figure 1:
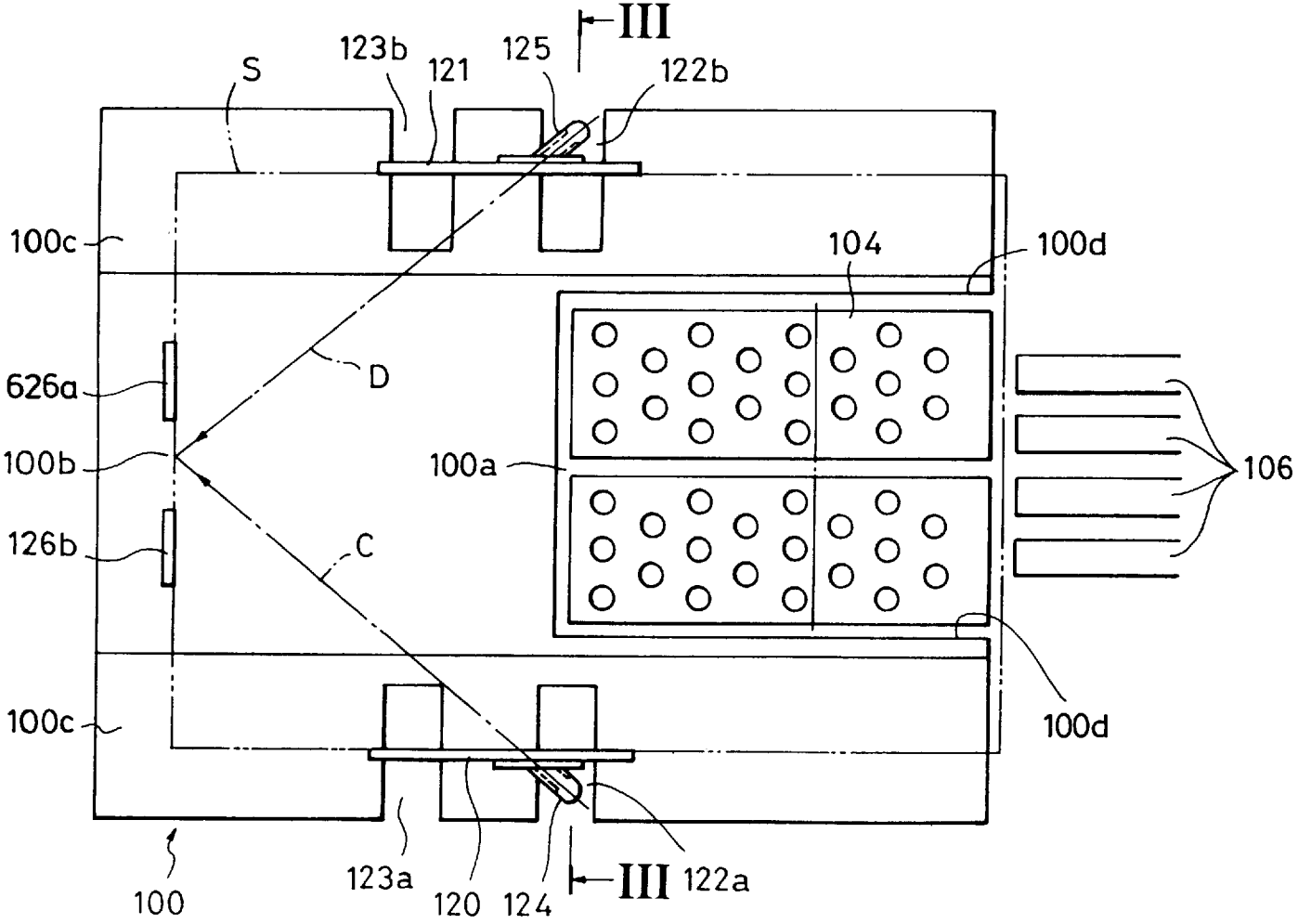
FIG. 1 is a plan view illustrating a sheet feeding device in accordance with an embodiment of the present invention.
Figure 2:
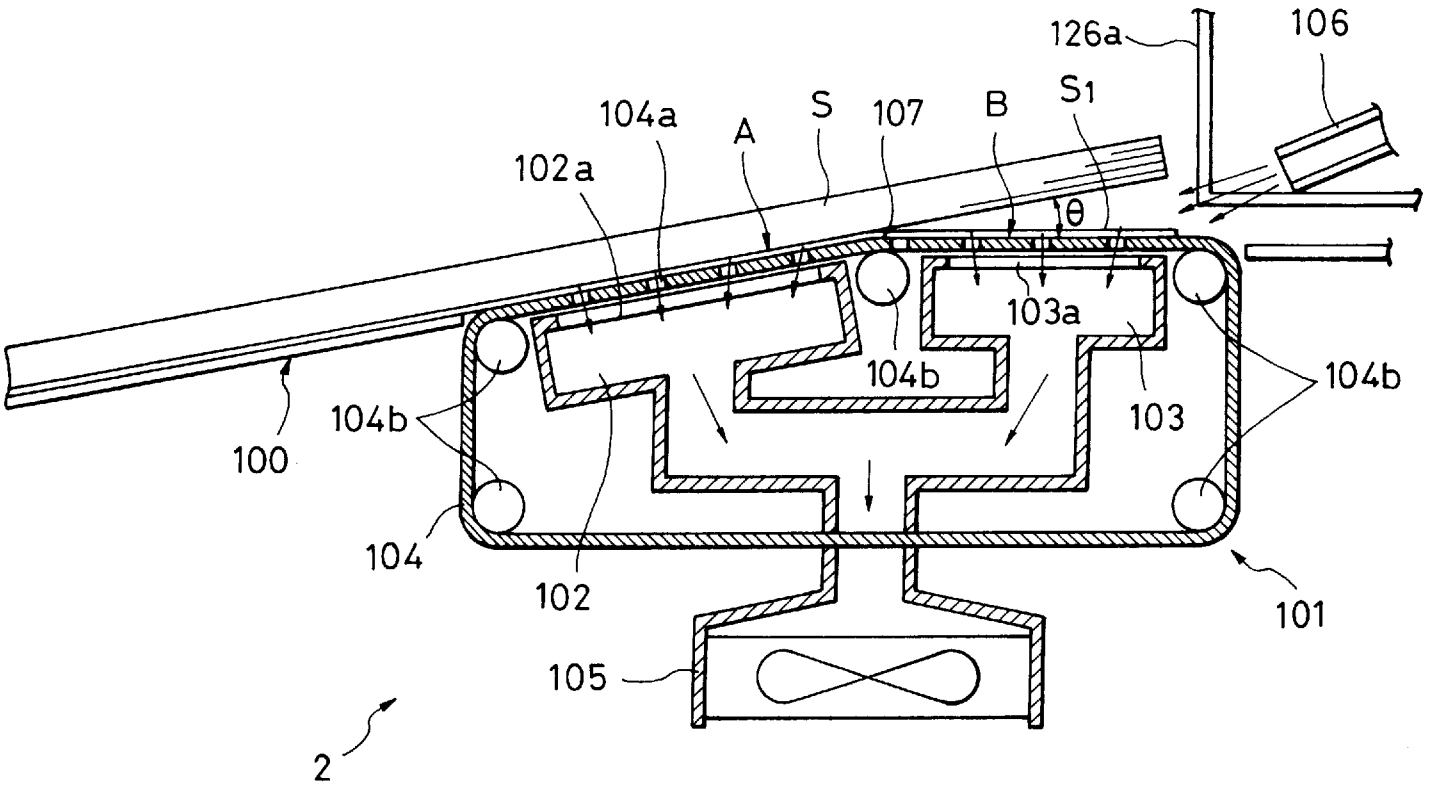
FIG. 2 is a sectional side view of the sheet feeding device in accordance with an embodiment of the present invention.
Figure 3:
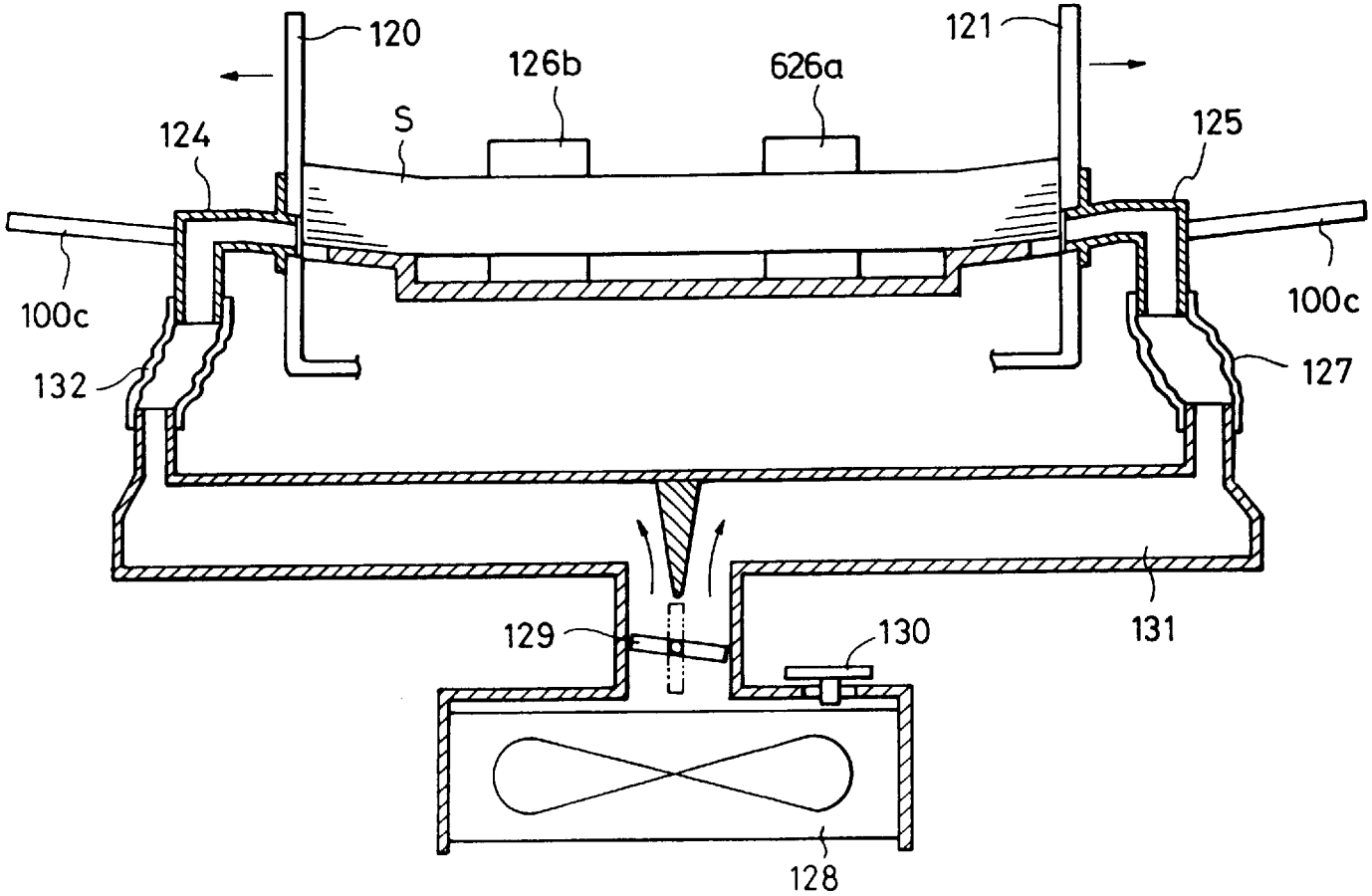
FIG. 3 is a sectional view taken along line III—III of FIG. 1, illustrating a state where small-size sheets are loaded.
Figure 4:
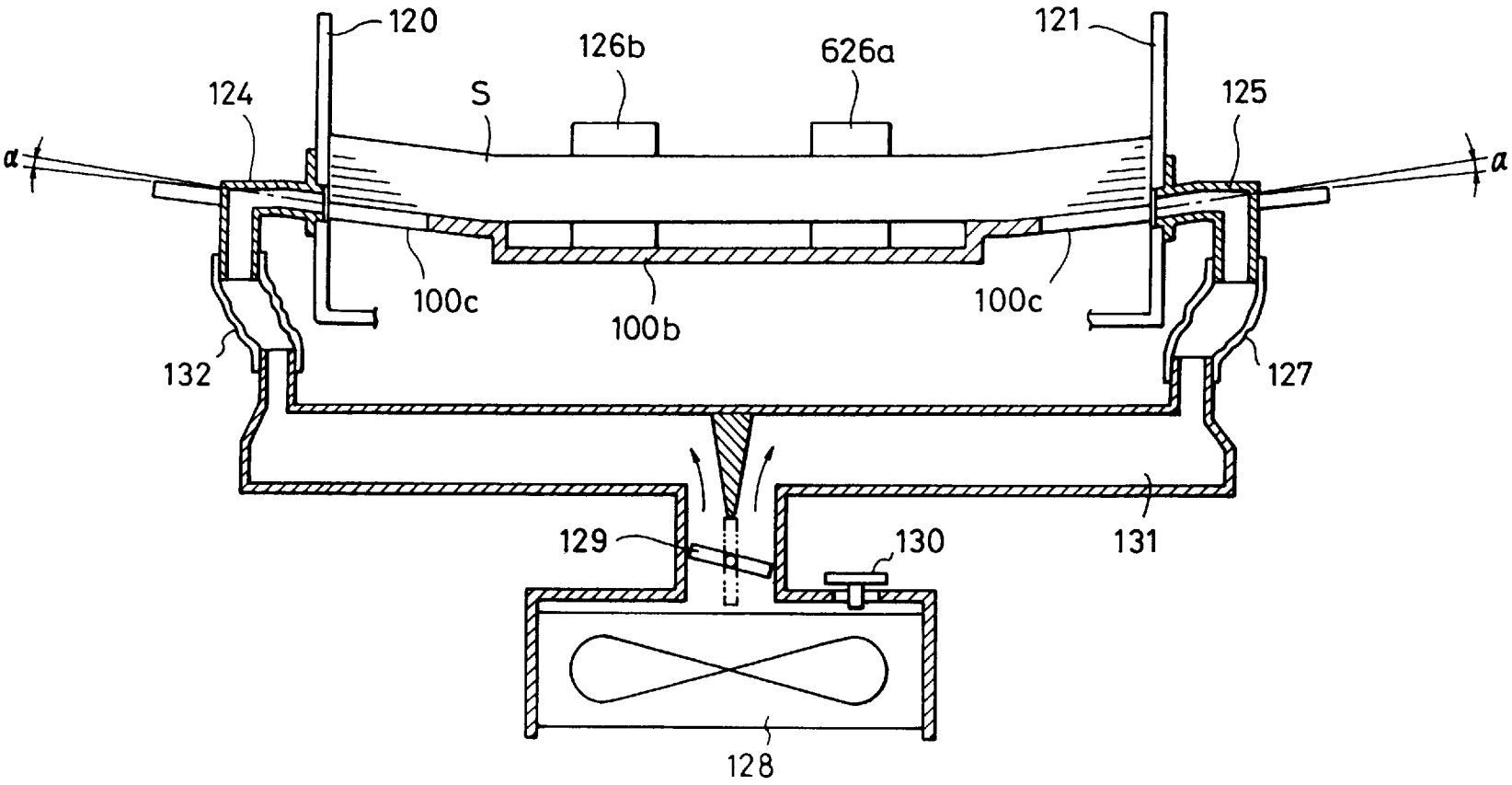

FIG. 1 is a plan view of a feeding device provided in a double side unit in accordance with an embodiment of the present invention, and FIG. 2 is a sectional side view of the same feeding device. FIG. 3 is a sectional view taken along line III—III of FIG. 1, illustrating a state wherein small-size sheets are loaded, and FIG. 4 is a sectional view taken along line III—III of FIG. 1, illustrating a state wherein large-size sheets are loaded.

A feeding device 101 comprises a sheet tray 100 for loading sheets S thereon, sheet holding means disposed below the sheet tray 100 on the downstream side in the feeding direction so as to hold the bottom sheet S1, conveyance means for conveying the bottom sheet S1 held by the sheet holding means, an air injection nozzle (first air injection means) 106 for injecting air toward the leading end of the sheets S loaded on the sheet tray 100, and a guide plate 126*a* for regulating the leading ends of the sheets S.

The sheet holding means comprises a first suction chamber 102 having an upper suction opening 102*a*, a second suction chamber 103 having an upper suction opening 103*a*, and a blower 105 connected to both suction chambers 102 and 103. The first suction chamber 102 positioned on the upstream side is disposed so that the suction opening 102*a* is inclined downwardly on the upstream side thereof. The second suction chamber 103 positioned downstream of the first suction chamber 102 is disposed so that the suction opening 103*a* is substantially horizontal.

A conveyance belt 104 is provided so as to cover the suction openings 102*a* and 103*a* of the first and second suction chambers 102 and 103. The conveyance belt 104 has a plurality of suction holes 104*a* and is placed on a plurality of rollers 104*b* which are appropriately arranged so that the conveyance plane for holding a sheet is at a predetermined angle θ at an inflection point between the first and second suction chambers 102 and 103. The conveyance belt 104 is moved by a driving force transmitted from a motor (not shown).

The first suction chamber 102 and a portion of the conveyance belt 104 which is opposite thereto forms first holding portion A, and the second suction chamber 103 and a portion of the conveyance belt 104 which is opposite thereto forms second holding portion B. The holding surface of the first holding portion A is at the predetermined angle θ, and the holding surface of the second holding portion B is substantially horizontal.

In the sheet tray 100 is formed a notch 100*a* in which the sheet holding means and conveyance means are disposed. The sheet tray 100 has a base 100*b* formed in the widthwise central portion thereof, and both sides 100*c* which are formed on the both sides of the base 100*b* so as to be upwardly inclined. The base 100*b* is substantially parallel to the conveyance surface adjacent the first suction chamber 102 so as to uniformly contact the sheets S.

The air injection nozzles 106 are provided so as to inject air downwardly toward the upper side of the second holding portion B on the downstream side of the sheet tray 100. A plurality of air injection nozzles 106 are provided in a portion corresponding to the suction region of the conveyance belt 104 in the widthwise direction of the sheets S, as shown in FIG. 1, so as to apply an air flow from a blower (not shown) against the leading ends of the sheets. Air injection nozzles 106 serve as first air injection means.

The guide plate 126*a* is perpendicularly provided at a position corresponding to the end of the conveyance belt 104 on the downstream side so as to regulate the leading ends of the sheets S on the sheet tray 100 in contact between the guide plate 126*a* and the sheets S. Between the guide plate 126*a* and the conveyance belt 104, a passage is formed for conveying the separated sheet S.

In the foregoing construction, the sheets S are adhered to the conveyance belt 104 by the suction force of blower 105 through suction openings 102*a* and 103*a* of the first and second suction chambers 102 and 103, and the suction holes 104*a* of the conveyance belt 104. At this time, since the holding surface of the conveyance belt 104 is bent at point 107 at the predetermined angle θ, only the bottom sheet S1 adheres, and the other sheets S are straight due to their stiffness, thereby separating only the bottom sheet S1. At the same time, air is injected between the bottom sheet S1 and the other sheets from the air injection nozzles 106 to float the other sheets S. As a result, only the bottom sheet S1 is securely separated and supplied.

The feeding device 101 of this embodiment can be used as a device for feeding again a sheet with a copy on one side thereof for copying on both sides of the sheet or multiple copying on one side thereof, as in an image forming apparatus (copying machine) which will be described below.

In the feeding device 101, therefore, when a sheet with a copy on one side thereof, which has been passed through the process below, is received by the sheet tray 100, the positions of a pair of side regulating plates 120 and 121 provided on the sheet tray 100 are automatically adjusted in accordance with the sheet size so as to regulate the side end of the sheet S on the tray 100 in the widthwise direction thereof.

The side regulating plates 120 and 121 are fitted into notches 122*a*, 122*b* and 123*a*, 123*b*, respectively, which are provided in the sheet tray 100, so as to project upwardly from the sheet tray 100. The side regulating plates 120 and 121, which may serve as side regulating means, can be moved along the notches 122*a*, 122*b* and 123*a*, 123*b*, respectively, by means of a rack and a pinion. The side regulating plates 120 and 121 may be adapted for regulating the side ends of the sheets in contact with the regulating plates 120 and 121 after the sheets are loaded, as described above. Alternatively, the side regulating plates 120 and 121 may be adapted for regulating the sheet position by receiving a sheet which is waved and discharged on an intermediate tray after the regulating plates are moved to the predetermined positions at a distance slightly greater than the width of the sheet size.

As illustrated in FIGS. 3 and 4, to the side regulating plates 120 and 121 are fixed nozzles (second air injection means) 124 and 125, respectively, so that the nozzles 124 and 125 are respectively fit into the openings provided in the side regulating plates 120 and 121. Air flows toward the side ends of the sheets S from the nozzles 124 and 125 connected to another blower 128 through flexible tubes 127 and 132 and a duct 131.

Namely, in this feeding device 101, in addition to the air injection nozzles 106, the nozzles 124 and 125 are provided for injecting the air flows between the respective sheets from the side ends thereof. Even for longitudinal feeding of large-size sheets, therefore, the sheets are securely separated and supplied.

The position and direction of each of the nozzles 124 and 125 should be set so as to assist -the sheet separating function of the air injection nozzles 106 at the leading ends of the sheets. As shown by arrows C and D in FIG. 1, the position and direction are preferably set so that the air flows are injected toward the trailing ends of the sheets S, i.e., to sheet trailing end regulating plates 626*a* and 126*b* which can be moved in the feeding direction. The position of each of the nozzles 124 and 125 in the feeding direction preferably corresponds to the boundary 107 between a floating portion and a non-floating portion when the leading ends of maximum-size sheets are floated by the air injection nozzle 106. It was found from experiment by the applicant that the optimum position corresponds to substantially the center of the length of maximum-size sheets in the feeding direction (the length of a long side).

The vertical position of each of the nozzles 124 and 125 is parallel to the sheet loading surfaces of both side portions 100*c* of the sheet tray 100 or slightly inclined upwardly (the angle α shown in FIG. 4) from the sheet loading surfaces so as to sufficiently inject air between the respective sheets.

The injection of the air flow from each of the nozzles 124 and 125 provided on the side regulating plates 120 and 121 is controlled by a valve (control means) 129 which is driven by a solenoid or the like which is not shown in the drawings, only in feeding of large-size sheets such as A3, B4, LDR and LGL sheets, which are appropriately selected. This permits effective separation of large-size sheets by using air, and prevents flapping of small-size sheets and defect in feeding due to the flapping. The blower 128 is provided with a regulating valve 130 for bleeding air from the blower 128 when the valve 129 is closed. The injection of the air flows may be turned on and off by controlling a solenoid in linkage with the movement of the side regulating plates 120 and 121.

The time of injection of the air flows from the nozzles 124 and 125 at the side ends of the sheets occurs a set time after the front portions of the sheets S are floated by injection of the air flow from the air injection nozzles 106 at the leading end of the sheets. This time setting prevents unnecessary flapping of the sheets.

As described above, the feeding device 101 permits injection of air to the trailing ends of large-size sheets, which are longitudinally placed on the sheet tray 100, by the air injection nozzles 106 for injecting air to the leading ends of the sheets and the nozzles 124 and 125 for injecting air to the side ends of the sheets. It is thus possible to securely separate and feed large-size sheets one by one and prevent multiple feeding.

In addition, since the nozzles 124 and 125 for injecting air to the side ends of the sheets are fixed to the side regulating plates 120 and 121, respectively, air can effectively be injected in contact with the side ends of sheets of any size on the sheet tray 100.

The flowrate of the air flow from each of the nozzles 124 and 125 may be adjusted by valve means in accordance with the number of sheets loaded and the weight thereof.

A plurality of nozzles 124 and 125 may be provided on the side regulating plates 120 and 121, respectively, and the sectional shape of the nozzles 124 and 125 can be appropriately selected in combination with the blower 128.

Exhaust air from the suction blower 105 may be introduced into the duct 131 in place of use of the blower 128. This can decrease the number of blowers and thus cause improve economy, and the decrease in the number of blowers as electrical parts also leads to improvement in the reliability of the feeding device. Further, since air is efficiently injected for separating sheets, the size and rotational speed of the blower is not excessively increased, thereby causing great advantages for noise and cost.

An image forming apparatus (copying machine) provided with the foregoing feeding device 101 is described below with reference to a sectional view of FIG. 5.

Figure 5:
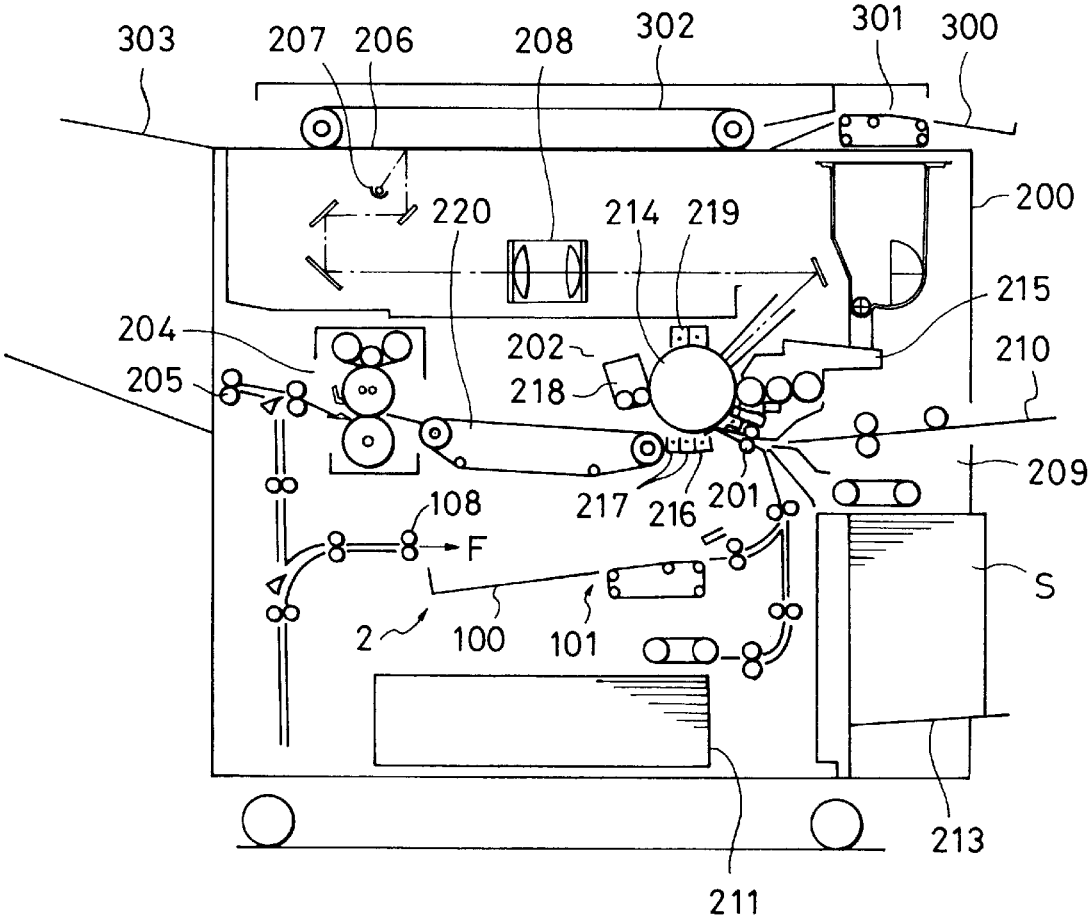
FIG. 5 is a sectional view illustrating an image forming apparatus (copying machine) comprising a feeding device according to the present invention.

Referring to FIG. 5, a body of an image forming apparatus 200 comprises an original base 206, a light source 207, a lens system 208, a feeding portion 209, and an image forming portion 202. The feeding portion 209 has a feeding tray 210, a cassette 211 and a paper deck 213. In the image forming portion 202 are disposed a cylindrical photosensitive body 214, a developing unit 215 containing a toner, a transfer charger 216, a separation charger 217, a cleaner 218, and a primary charger 219. A conveyance unit 220, a fixing unit 204, discharge rollers 205 and so on are disposed on the downstream side of the image forming portion 202.

In this image forming apparatus, when a feeding signal is output from a control device (not shown) provided in the apparatus body 200, sheets S are fed from the feeding tray 210, the cassette 211 or the paper deck 213. On the other hand, light emitted from the light source 207 and reflected from an original placed on the original base 206 is condensed on the photosensitive body 214 through the lens system 208. The photosensitive body 214 is previously charged by the primary charger 219, and an electrostatic latent image is formed by the light reflected from the original. Then, a toner image is formed by the development unit 215.

The oblique movement of the sheet S supplied from the feeding portion 209 is corrected by register rollers 201, and the sheet S is timed and then sent to the image forming portion 202. In the image forming portion 202, a toner image on the photosensitive body 214 is transferred to the sheet S, and the sheet S to which the toner is transferred is charged by the separation charger 217 to a polarity opposite to the polarity of the transfer charger 216 to be separated from the photosensitive body 214.

The separated sheet S is conveyed by the conveyance device 220 to the fixing device 204 in which an unfixed transferred image is permanently fixed. The sheet S to which the image is fixed is discharged to the outside of the apparatus body 200 by the discharge rollers 205.

On the other hand, a double-side unit 2 is used for double-side copying or multiple copying. A sheet with a copy on one side thereof is discharged to the sheet tray 100 of the feeding device 101 provided on the double-side unit 2 in the direction shown by arrow F. The sheets loaded on the sheet tray 100 are securely separated and supplied again one by one from the bottom thereof, and sent to the image forming portion 202 for copying an image again through the register rollers 201. Thus, the sheet S first supplied from the feeding portion 209 is subjected to double-side copying or multiple copying and then discharged to the outside of the apparatus body 200.

The present invention is not limited to the above embodiment, and can be applied to an automatic original feeding device (ADF) for automatically feeding originals.

An example of such an automatic original feeding device roughly comprises an original tray 300 for loading an original thereon, a feeding device 301 to which the present invention is applied, a conveyance belt 302 for conveying the original sent from the original tray 300 by the feeding device 301 while holding the original between the conveyance belt 302 and an original base 206, and a discharge tray 303 on which original is loaded after an image is read by the original reading means.

The feeding device can also be arranged so as to separate and feed loaded sheets one by one from the top thereof.

(Second Embodiment)

Figure 6:
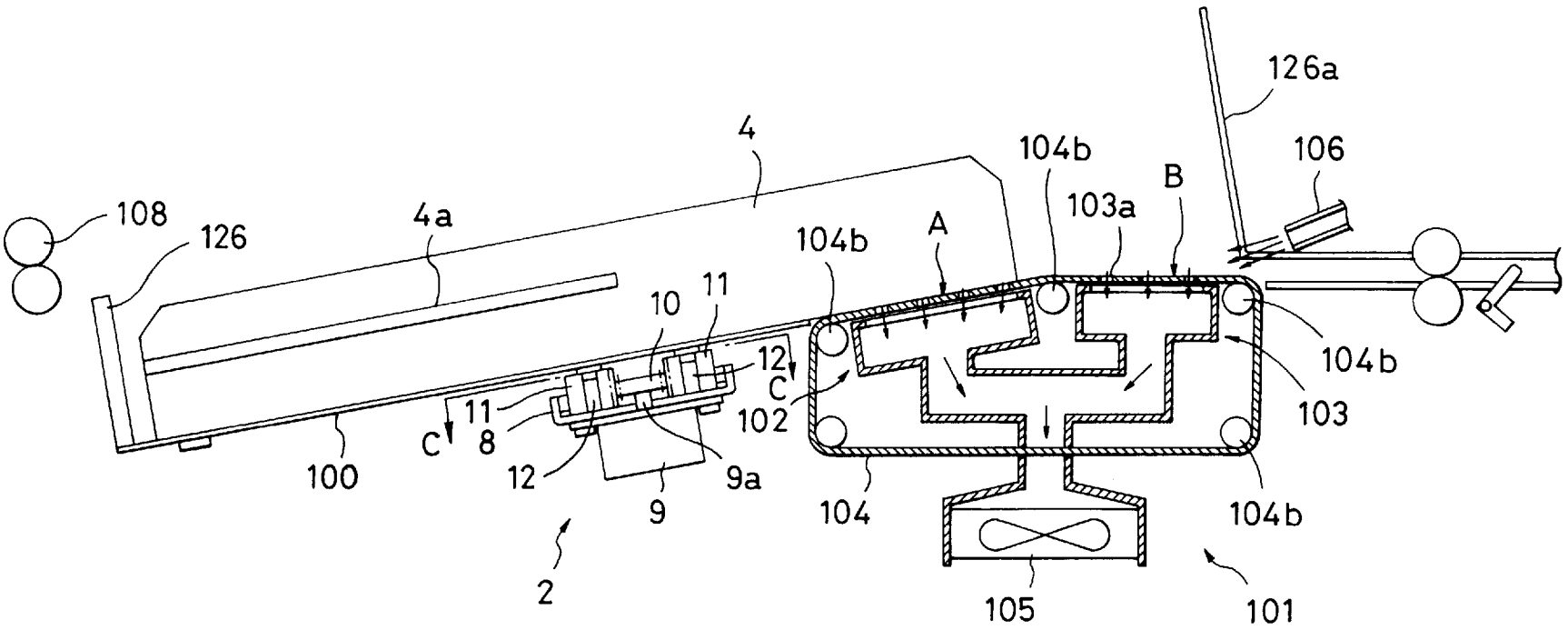
FIG. 6 is a longitudinal sectional view illustrating a sheet feeding device in accordance with a second embodiment of the present invention.
Figure 7:
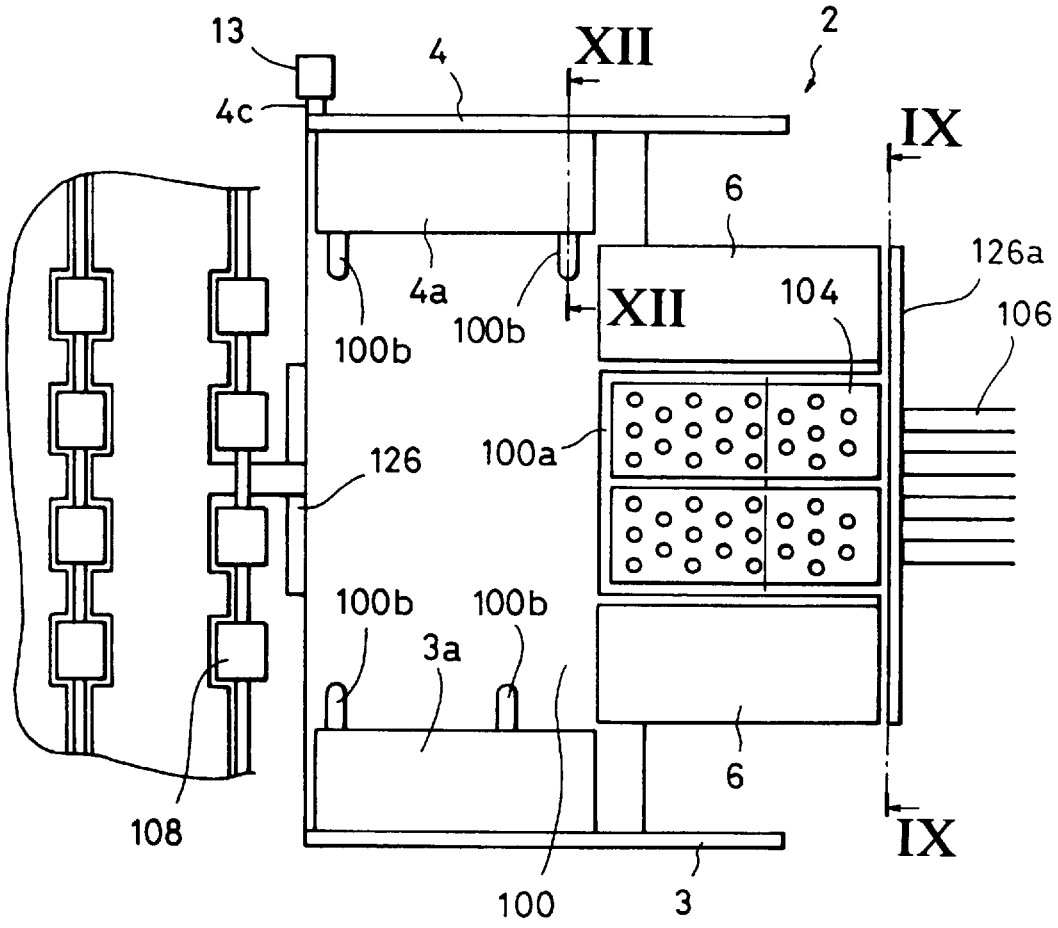
FIG. 7 is a plan view illustrating the sheet feeding device in accordance with the second embodiment.
Figure 8:
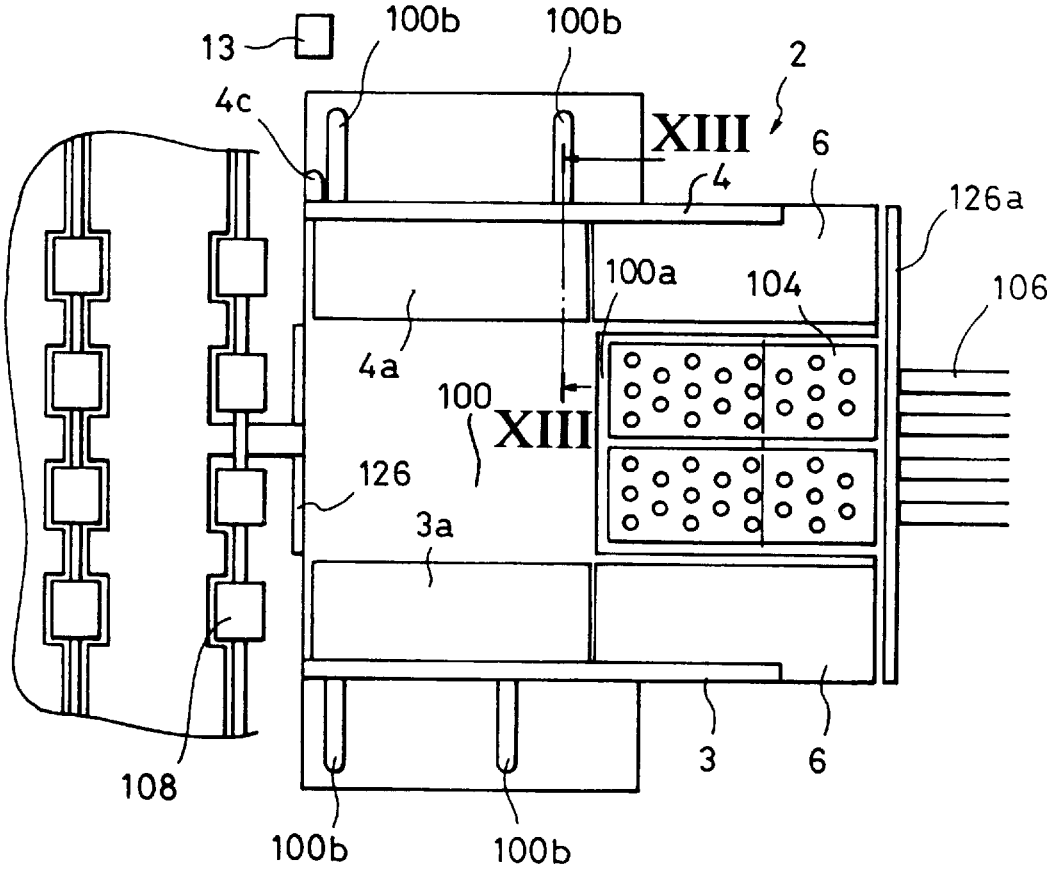
FIG. 8 is a drawing illustrating the operation of the feeding device of FIG. 7.
Figure 9:
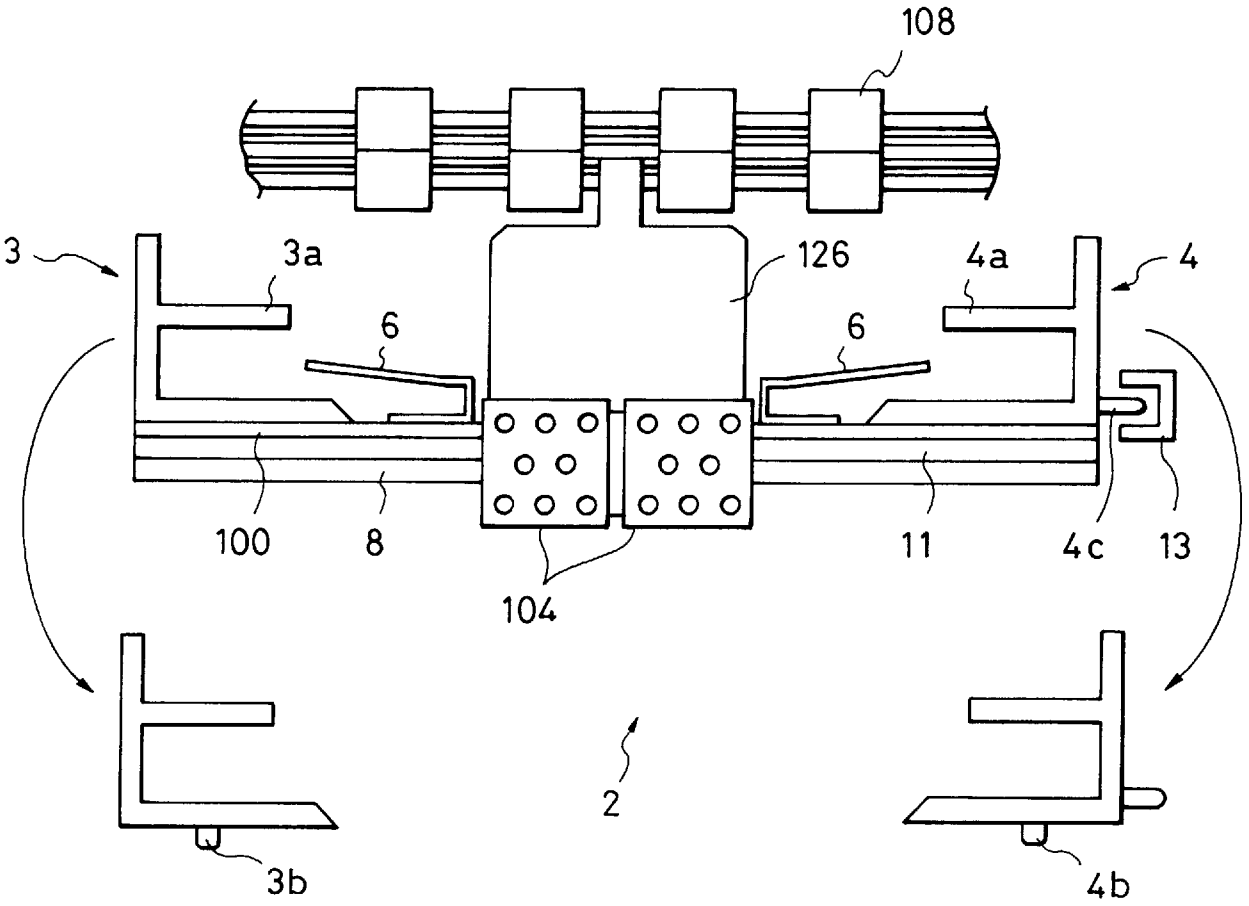
FIG. 9 is a front view illustrating the sheet feeding device of FIG. 7.

FIGS. 6 to 9 are drawings illustrating the double-side unit 2 equipped with a sheet feeding device in accordance with a second embodiment of the present invention. FIG. 6 is a longitudinal sectional view of the double-side unit 2, FIGS. 7 and 8 are plan views of the double-side unit 2, and FIG. 9 is a sectional view taken along line IX—IX in FIG. 7.

In FIG. 6, a sheet conveyance means and an air injection nozzle 106 are disposed on the downstream side of the sheet tray 100, on which sheets S are loaded, in the feeding direction.

In FIG. 9, reference numerals 3 and 4 denote side regulating plates (side regulating means) for regulating the widthwise position of the sheets loaded in the double-side unit 2, and reference numeral 100 denotes a sheet tray. The side regulating plates 3 and 4 are provided at two positions in the widthwise direction of the sheet tray 100. The sheet tray 100 functions as an intermediate tray for feeding again the sheets which were loaded thereon and subjected to image formation.

The side regulating plate 3 comprises a L-formed member having a bottom plate and a side plate. A sheet supporting member 3*a* is provided on the inner surface of the side plate at a predetermined height so as to extend toward the center of the sheet tray 100.

The side regulating plate 3 also has a pair of pins 3*b* provided on the lower side of the bottom plate along the loading direction (feeding direction) of the sheets S. The pins 3*b* freely engage a pair of elongated holes (not shown) which are formed in the sheet tray 100 so that the side regulating plate 3 can be moved along the widthwise direction of the sheet tray 100. The side regulating plate 3 and the sheet supporting member 3*a* and the pins 3*b*, which are provided on the regulating plate 3, are formed by integral molding.

Similarly, the other side regulating plate 4 has a sheet supporting member 4*a* which is the same as the sheet supporting member 3*a*, and a pair of pins 4*b* which engage the pair of elongated holes (not shown) in the sheet tray 100. However, only the side regulating plate 4 has a shielding portion 4*c* formed on the outer surface of the side plate thereof. The shielding portion 4*c* is detected by a side regulating plate sensor 13 when the side regulating plate 4 is at an outside position. The side regulating plate 4 and the sheet supporting member 4*a*, the pins 4*b* and the shielding portion 4*c*, which are provided on the side regulating plate 4, are formed by integral molding, and can be moved along the widthwise direction of the sheet tray 100.

The sheet tray 100 is adapted for loading sheets S sent from the conveyance rollers 108 (sheet sending means) and inclined upwardly at an angle of about 10° in the loading direction of the sheets. In the sheet tray 100 is formed an opening 100*a* in which the sheet conveyance means is disposed.

A pair of wings 6 are provided on portions of the sheet tray 100 near each side of the sheet conveyance means so as to be inclined upwardly. The sheet tray 100 and a first suction chamber 102 are substantially parallel to each other, as shown in FIG. 6. The first holding area A is where the conveyance belt 104 passes over the first suction chamber 102 and is arranged so as to uniformly contact the sheets S. The second suction chamber 103 is substantially horizontally provided.

The mechanism 2 for driving the side regulating plates 3 and 4 will be described below.

Figure 10:
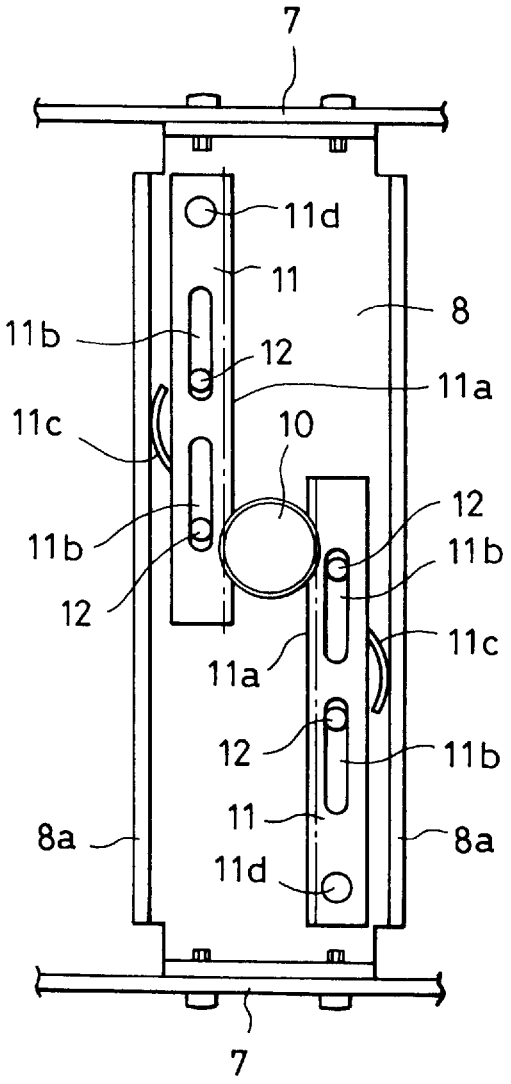
FIG. 10 is a plan view illustrating a sheet supporting member and a portion for driving a side regulating plate of the sheet feeding device of FIG. 7.
Figure 11:
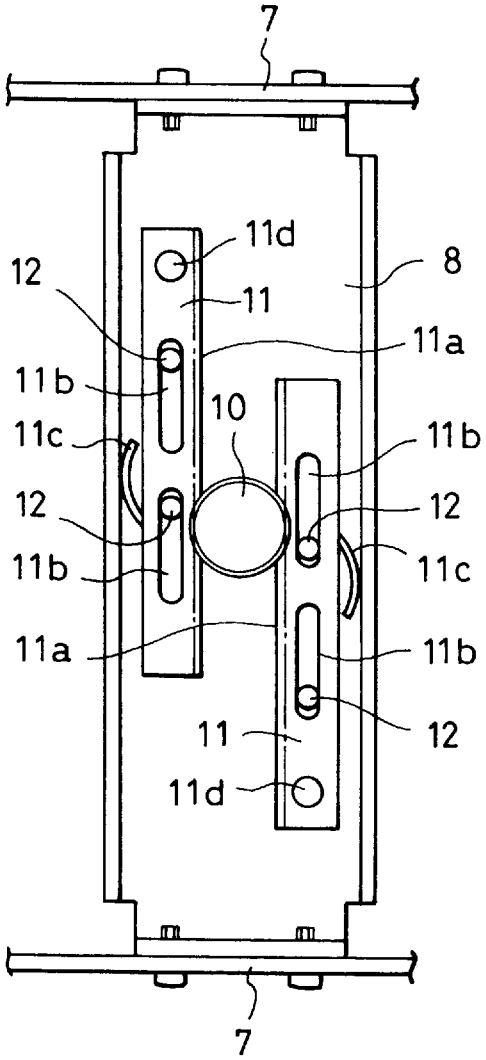
FIG. 11 is a plan view illustrating the sheet supporting member and the portion for driving the side regulating plate of the sheet feeding device of FIG. 7.

FIGS. 10 and 11 are drawings as viewed in the direction of arrow C in FIG. 6.

In FIG. 10, reference numerals 7 denote each of side plates provided at both sides of the double-side unit 2. To the side plates 7 is fixed, a drive stay 8 having front and rear side plates 8*a*. As illustrated in FIG. 6, a stepping motor 9, which may serve as driving means, is fixed at the center of the drive stay 8, and a pinion gear 10 is fixed to the output shaft 9a of the stepping motor 9.

As illustrated in FIG. 10, a pair of sliders 11 which have racks 11*a* formed on the sides thereof opposite to the pinion gear 10 and which are formed by molding are provided on both sides of the pinion gear 10. Four pins 12 caulked in the drive stay 8 respectively engage elongated holes 11*b* formed in the sliders 11 so that the sliders can be moved in the widthwise direction of sheets.

The drive transmitting mean (linkage mechanism) comprises the pinon gear 10, the sliders 11 and so on for transmitting driving of the stepping motor 9 to the side regulating plates 3 and 4 and the sheet supporting members 3*a* and 4*a*.

FIG. 11 is a drawing showing a state where each of the sliders 11 is moved inwardly (toward the center of the drive stay 8). A pair of urging members 11*c* are respectively integrally provided on the sliders 11 opposite to the racks 11*a* thereof. During movement of the sliders 11, therefore, the urging members 11*c* always contact the respective side plates 8*a* of the drive stay 8 so as to urge the sliders 11 to the side of the pinion 10. Thus, tooth contact between the racks 11*a* and the pinion 10 can be kept constant.

Figure 12:
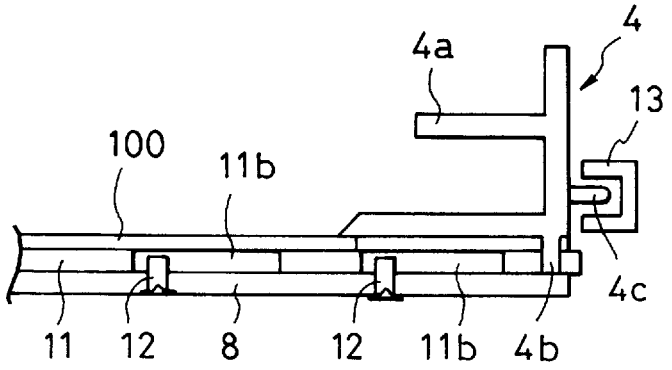
FIG. 12 is a longitudinal sectional side view (taken along line XII—XII of FIG. 7 illustrating the side regulating plate and the sheet supporting member of the second embodiment.
Figure 13:
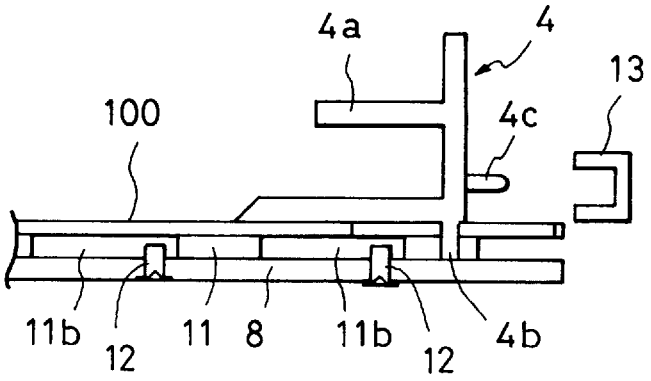
FIG. 13 is a longitudinal sectional side view taken along line XIII—XIII of FIG. 8 illustrating the side regulating plate and the sheet supporting member of the second embodiment.

FIG. 12 is a sectional view taken along line XII—XII in FIG. 7, and FIG. 13 is a sectional view taken along line XIII—XIII in FIG. 8, illustrating a state where the sliders 11 are moved toward the center of the drive stay 8. In FIG. 12, a pin 4*b* provided on the side regulating plate 4 is fitted into a round hole lid of one of the sliders 11 shown in FIG. 10, and stop means is provided for preventing the pin 4*b* from slipping off from the round hole 11*d*. The side regulating plate 3 also has the same structure. Namely, the side regulating plates 3 and 4 are moved with the movement of the sliders 11 fixed thereto.

The operation from loading of sheets S on the double-side unit 2 to separation and conveyance of the sheets will be described below.

(1) When double-side copying on a large number of large-size sheets (for example, the maximum loadable number N) is selected by an operation section (not shown) of a copying machine, the operation is as follows:

Illustrated in FIG. 7, the side regulating plates 3 and 4 are retracted towards the sides of the sheet tray 100, and the sheet supporting members 3*a* and 4*a* of the side regulating plates 3 and 4 are at the retracted position where they do not contact the sheets S conveyed by the conveyance rollers 108 for the double-side unit 2.

At this time, the shielding portion 4*c* of the side regulating plate 4 blocks light from detection by the side regulating plate photosensor 13, detecting that the sheet supporting members 3*a* and 4*a* are at the retracted position. In this state, a predetermined number of sheets S, for example N/2 sheets S, are loaded on the sheet tray 100.

After N/2 sheets S are completely loaded, a controller (drive control means) 30 controls the stepping motor to rotate it by a predetermined amount. A predetermined number of normal rotations of the stepping motor 9 (FIG. 6) causes the side regulating plates 3 and 4 to move positions at a distance slightly greater than the width of the sheets S, as shown in FIG. 7. When the side regulating plates are moved as described above, the sheet supporting members 3*a* and 4*b* which are integral with the side regulating plates 3 and 4, respectively, are at working positions where both sides of the sheets S are supported thereby.

Figure 14:
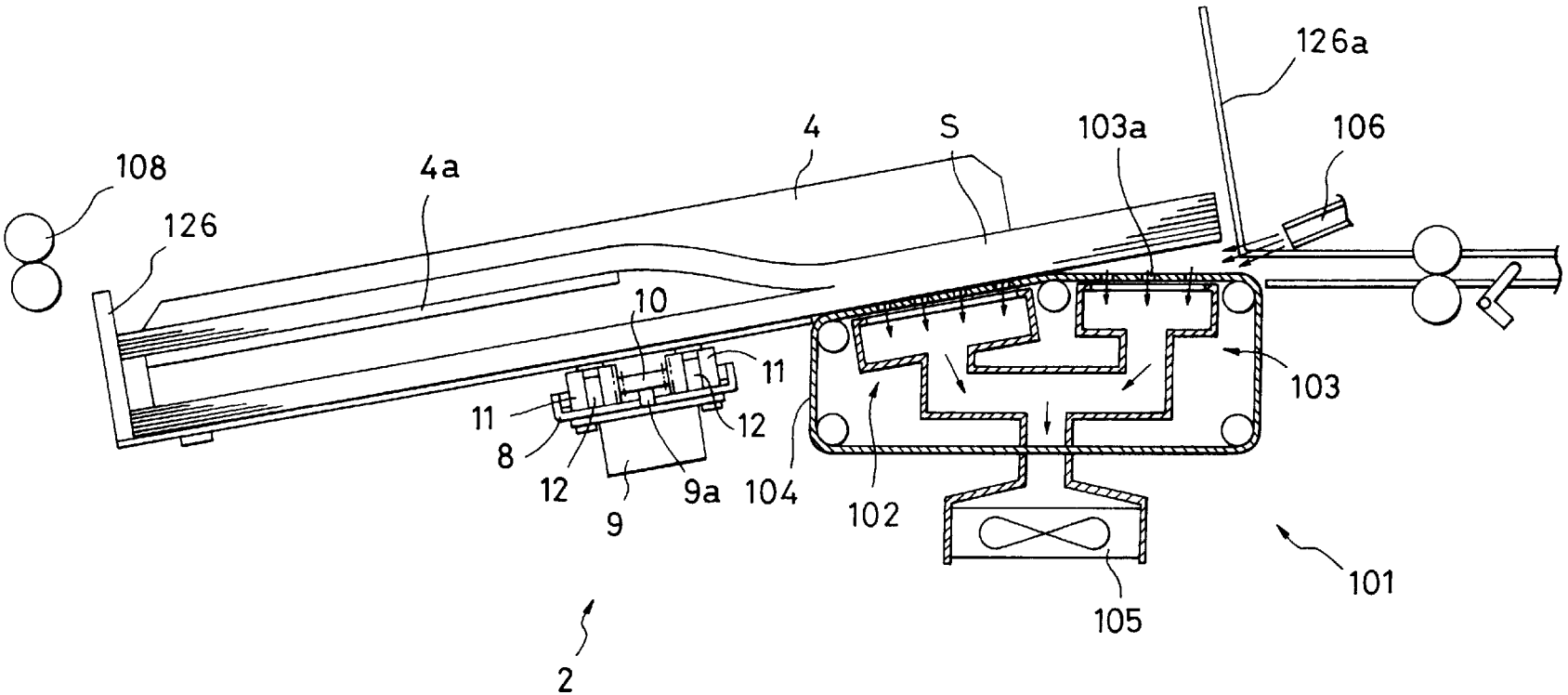
FIG. 14 is a longitudinal sectional side view illustrating the case where the sheet feeding device of the second embodiment has loaded large-size sheets.
Figure 15:
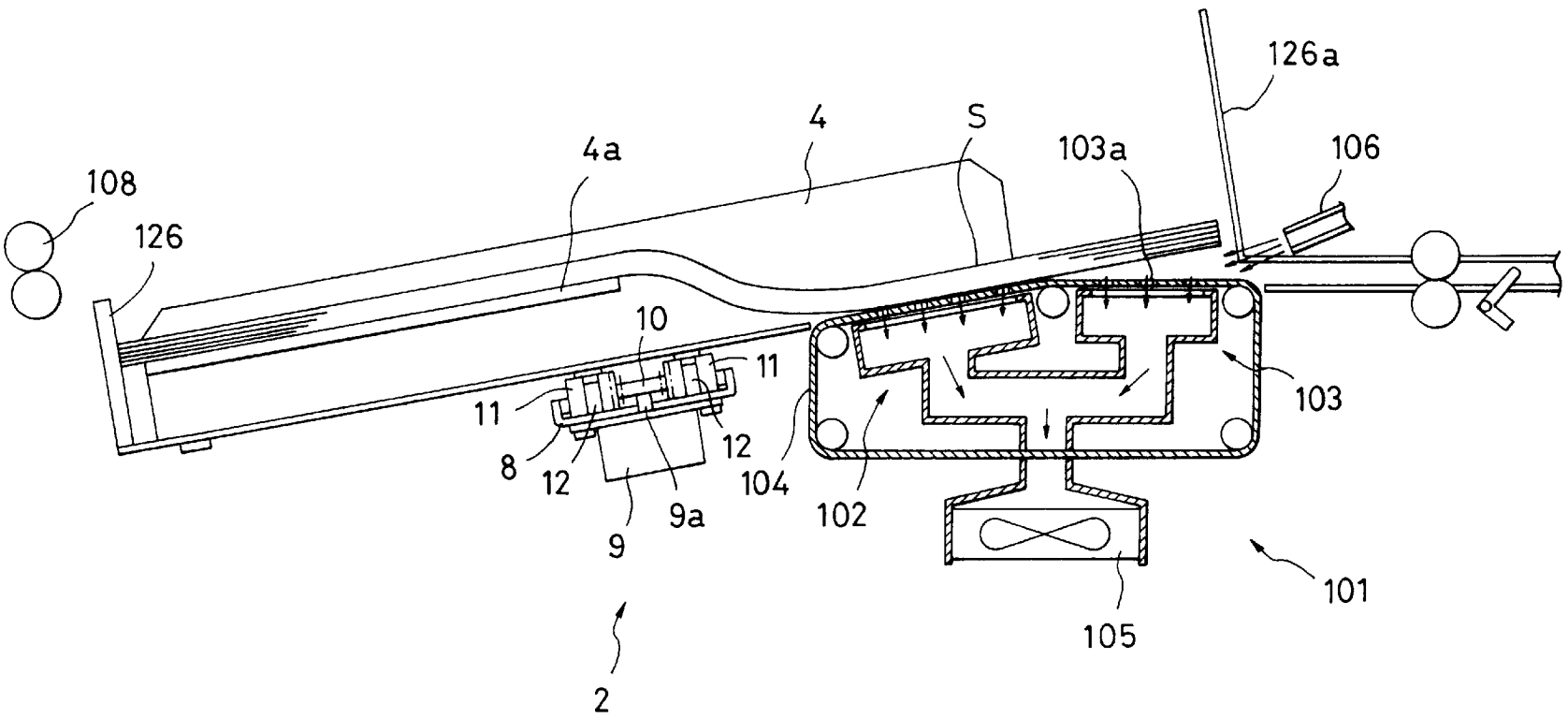
FIG. 15 is a longitudinal sectional side view illustrating the sheet feeding device of FIG. 14 in which large-size sheets are loaded.

Then, remaining N/2 sheets S are loaded on the 15 sheets S which have already been loaded on the sheet tray 100, and the sheet supporting members 3*a* and 4*a*, as shown in FIG. 14. In other words, the remaining sheets S are loaded in such a manner that the front portions thereof are placed on the conveyance belt 104 and the wings 6 (see FIG. 7), and the rear portions thereof are supported on the sheet supporting members 3*a* and 4*a* of the side regulating plates 3 and 4. After the N sheets S are completely loaded on the sheet tray 100, normal and reverse rotations of the stepping motor 9 are repeated so that the sheets S are adjusted in the widthwise direction by the side regulating plates 3 and 4.

The bottom sheet S of the sheets S which are loaded on the sheet tray 100 in the above-described manner adheres to the conveyance belt 104 by suction from the first suction chamber 102, and the leading end of the bottom sheet S is separated from the other sheets S and adhered to the conveyance belt 104 by suction force of the second suction chamber 103. The bottom sheet S is then conveyed to the downstream side by movement of the conveyance belt 104.

When the bottom sheet S is separated and conveyed, the weight of the sheets S loaded on the trailing end of the bottom sheet S results from half of the N sheets loaded on the sheet tray 100. Even for large-size sheets S, therefore, the bottom sheet S can easily be separated and conveyed, thereby preventing multiple feeding of the sheets S.

When the bottom sheet S is separated and conveyed, since air is injected to the bottom sheet S from the injection nozzles 106, air is supplied to between the bottom sheet S and the next sheet to facilitate separation and conveyance of the bottom sheet S.

In this case, the air flow supplied to between the first and second sheets S easily reaches the trailing ends of the sheets S because the weight of the trailing ends of the sheets S is reduced by the sheet supporting function of the sheet supporting members 3*a* and 4*a*, as described above. It is thus possible to securely separate and convey the bottom sheet S and prevent multiple feeding of the sheets S.

After all sheets S placed below the sheet supporting members 3*a* and 4*a* are completely separated and conveyed, as described above, the sheets S whose trailing ends are supported by the sheet supporting members 3*a* and 4*a* are separated and conveyed one by one, as shown in FIG. 5. The sheets S placed on the sheet supporting members 3*a* and 4*a* are also securely separated and conveyed one by one by the same operation as in FIG. 14, thereby preventing multiple feeding of the sheets S.

After all sheets on the sheet tray 100 are completely separated and conveyed as described above, the stepping motor is reversely rotated to move the side regulating plates 3 and 4 to the retracted positions. In this state, when the shield portion 4*c* of the side regulating plate 4 blocks light from the side regulating plate sensor 13, the stepping motor 9 is stopped for loading of the next sheets S.

(2) When double-side copying on a small number of large-size sheets (for example, M<N/2) is selected by the operation section (not shown) of the body 1 of the copying machine, the operation is as follows:

When such copying is selected, the side regulating plates 3 and 4 and the sheet supporting members 3*a* and 4*a* are at the retracted positions as shown in FIG. 7, and M sheets S are loaded. After the M sheets are completely loaded, the side regulating plates 3 and 4 are reciprocated to adjust the loaded sheets S in the widthwise direction thereof. In this case, the trailing ends of the sheets are not supported by the supporting members 3*a* and 4*a*. The operation of separating and conveying the sheets S after loading is the same as in the above case (1).

Figure 16:
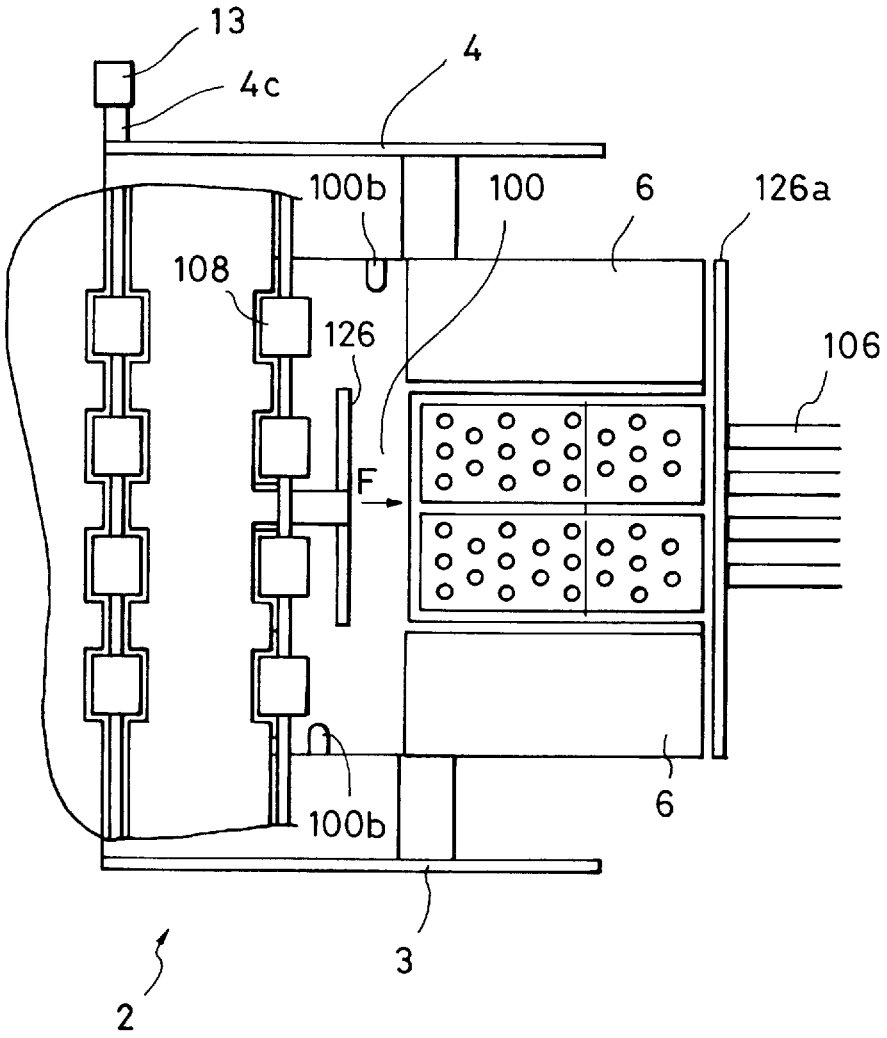
FIG. 16 is a plan view illustrating the second embodiment when a trailing end regulating plate and transfer rollers are moved when small-size sheets are loaded.
Figure 17:
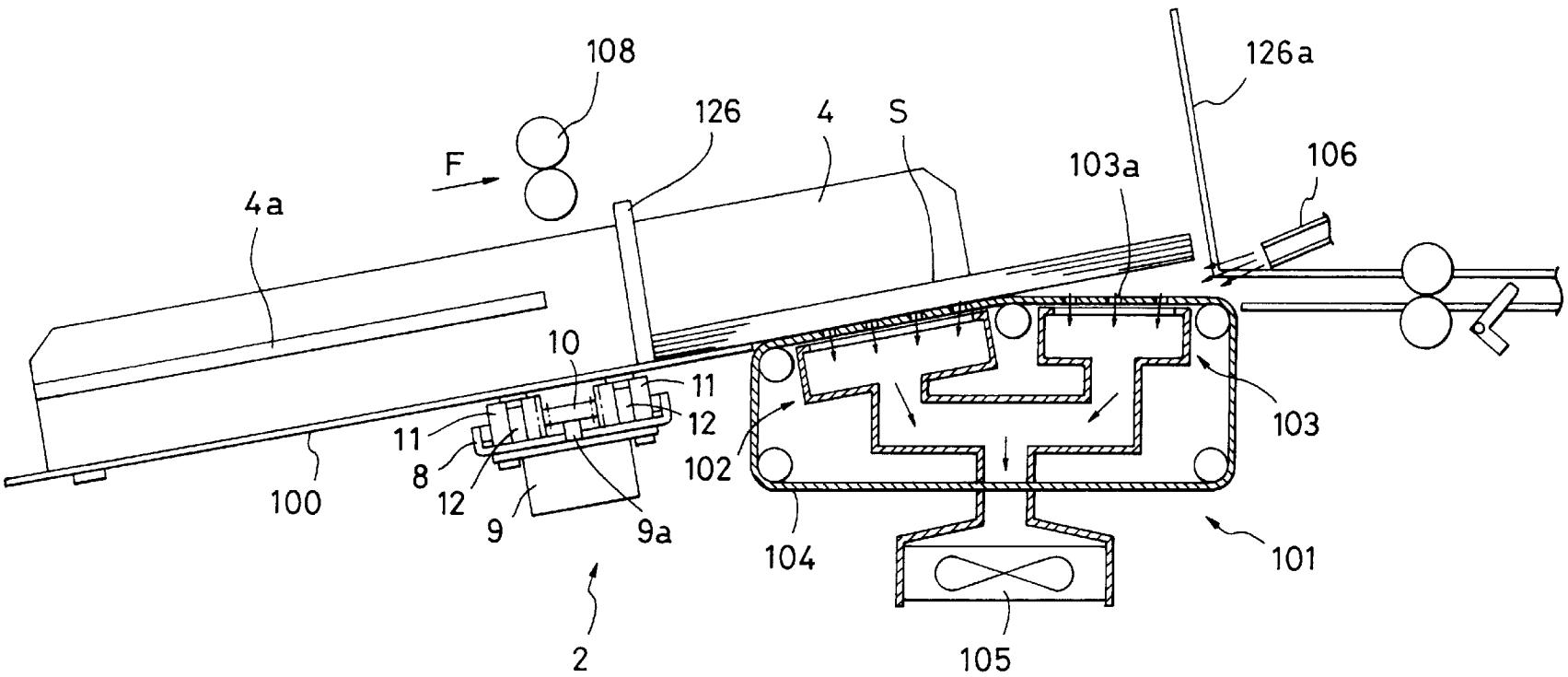
FIG. 17 is a longitudinal sectional side view illustrating the device shown in FIG. 16.

(3) When double-side copying on small-size sheets is selected by the operation section (not shown) of the body 1 of the copying machine, the operation is as follows:

The conveyance rollers 108 and the trailing end regulating plate 126 for the double-side unit, which are at the positions shown in FIGS. 6 and 7 in loading of large-size sheets, are moved in the direction of the arrow F shown in FIGS. 16 and 17 in accordance with the size of sheets S. When small-size sheets S are discharged, the conveyance rollers 108 and the trailing end regulating plate 126 are moved to the downstream side of the conveyance direction (in the direction of the arrow F) for discharging small-size sheets. In the state where the side regulating plates 3 and 4 are at the retracted positions, as shown in FIG. 16, the sheets S are loaded. After the sheets S are completely loaded, the side regulating plates 3 and 4 are reciprocated to adjust the sheets S in the widthwise direction thereof. In this case, the trailing ends of the sheets are not supported by the supporting members 3*a* and 4*a*. The subsequent operation of separating and conveying the sheets S is the same as in the case (1).

(Third Embodiment)

A third embodiment of the present invention is described with reference to FIGS. 18 to 22.

Figure 18:
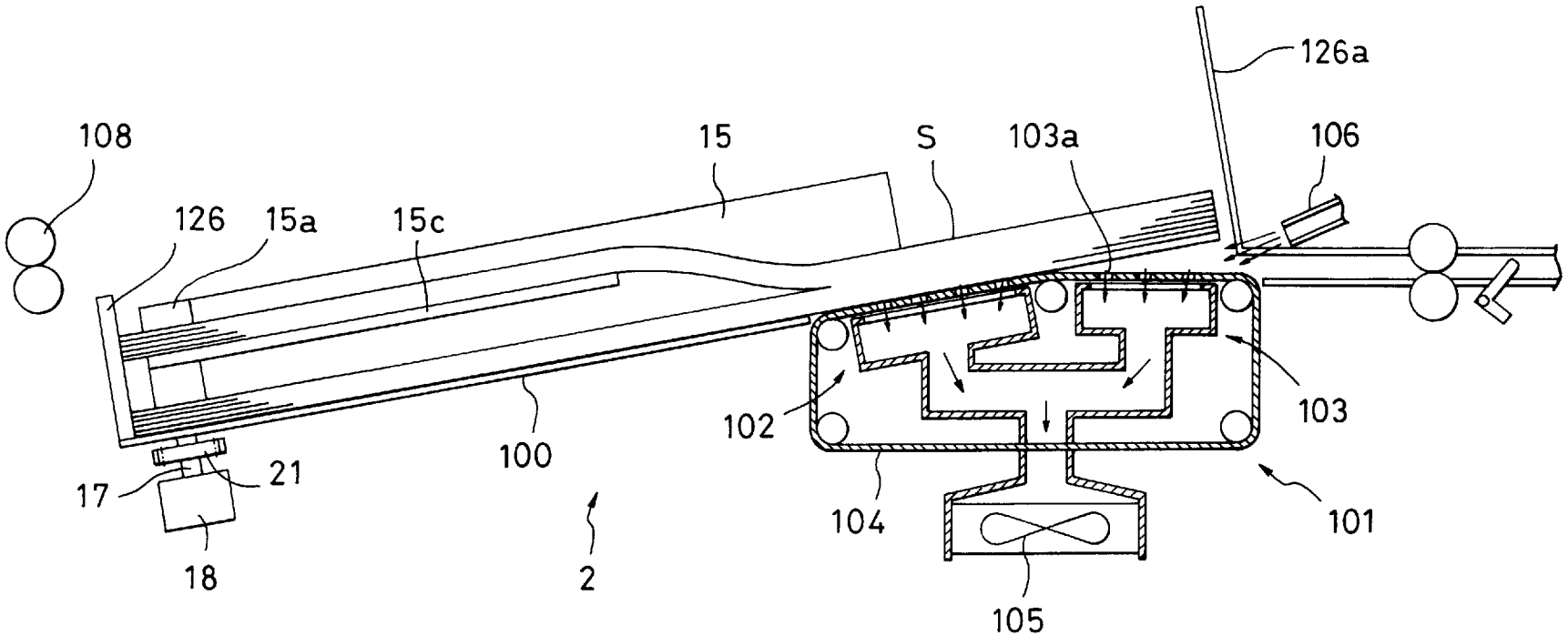
FIG. 18 is a longitudinal sectional side view illustrating a sheet feeding device in accordance with a third embodiment of the present invention.
Figure 19:
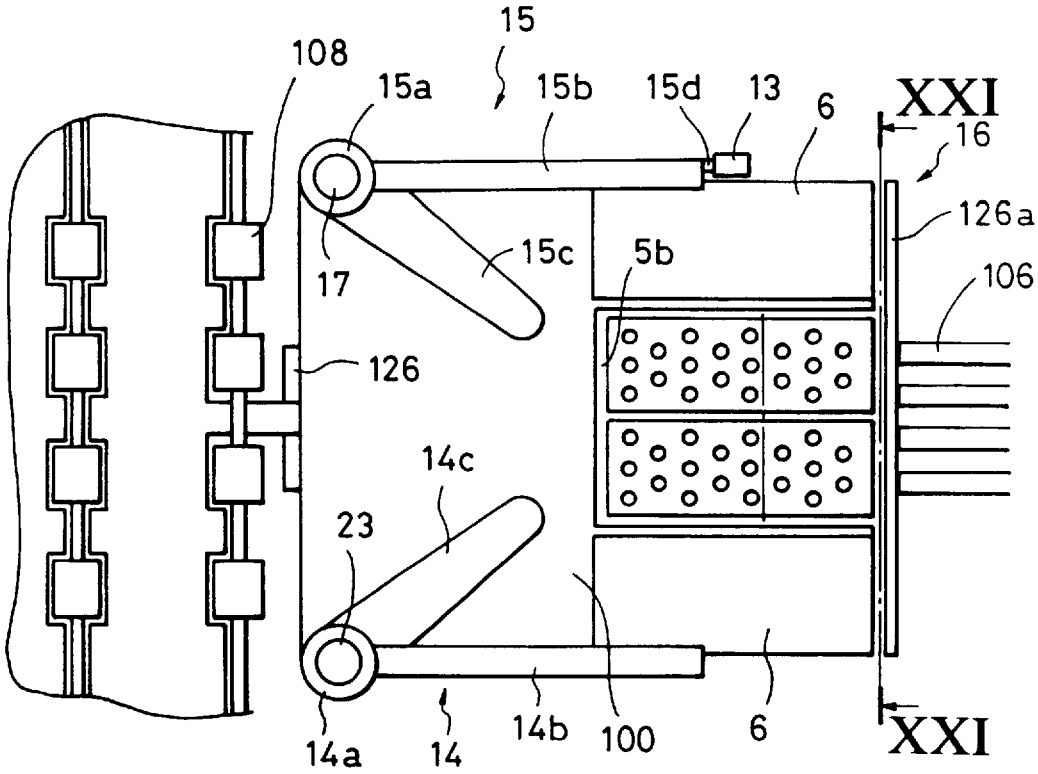
FIG. 19 is a plan view illustrating the sheet feeding device in accordance with the third embodiment.
Figure 20:
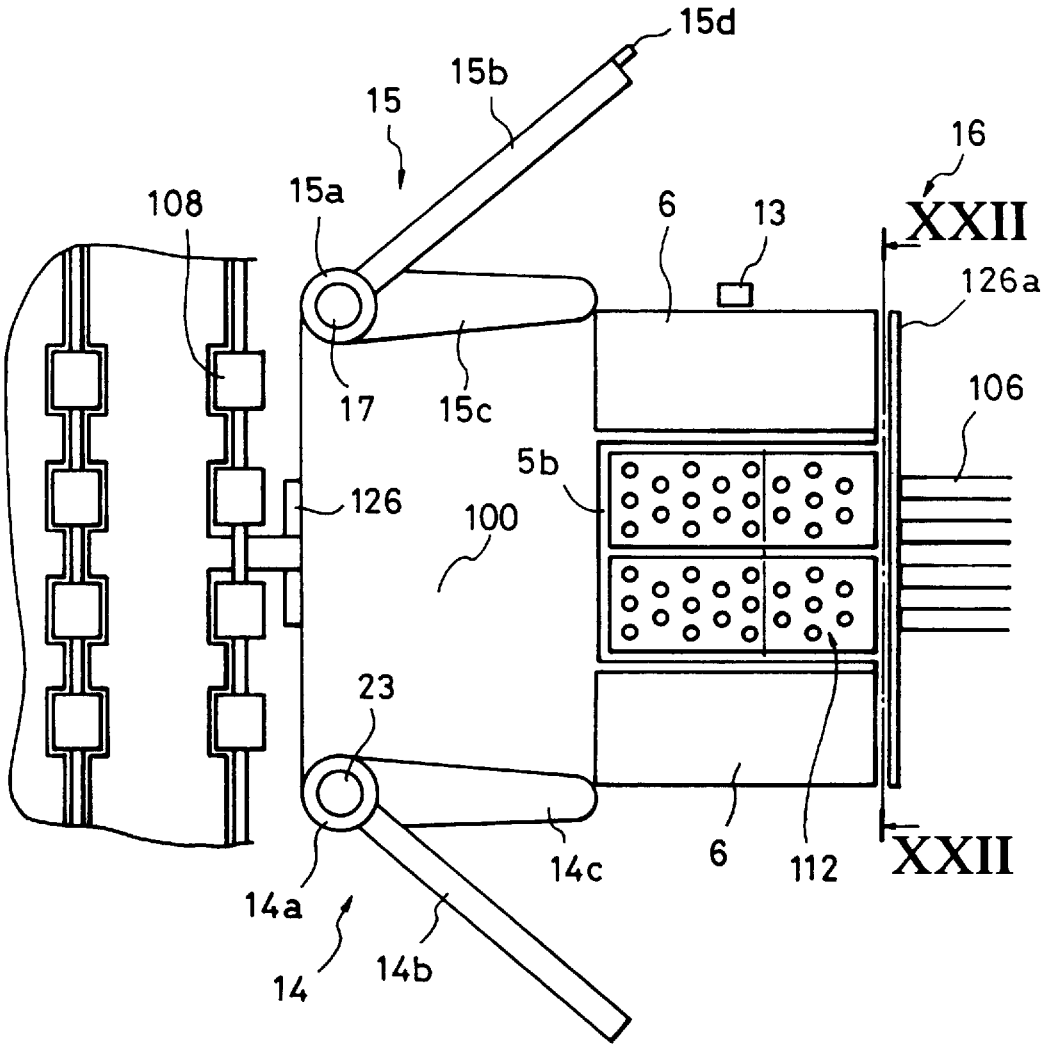
FIG. 20 is a plan view illustrating the sheet feeding device in accordance with the third embodiment.
Figure 21:
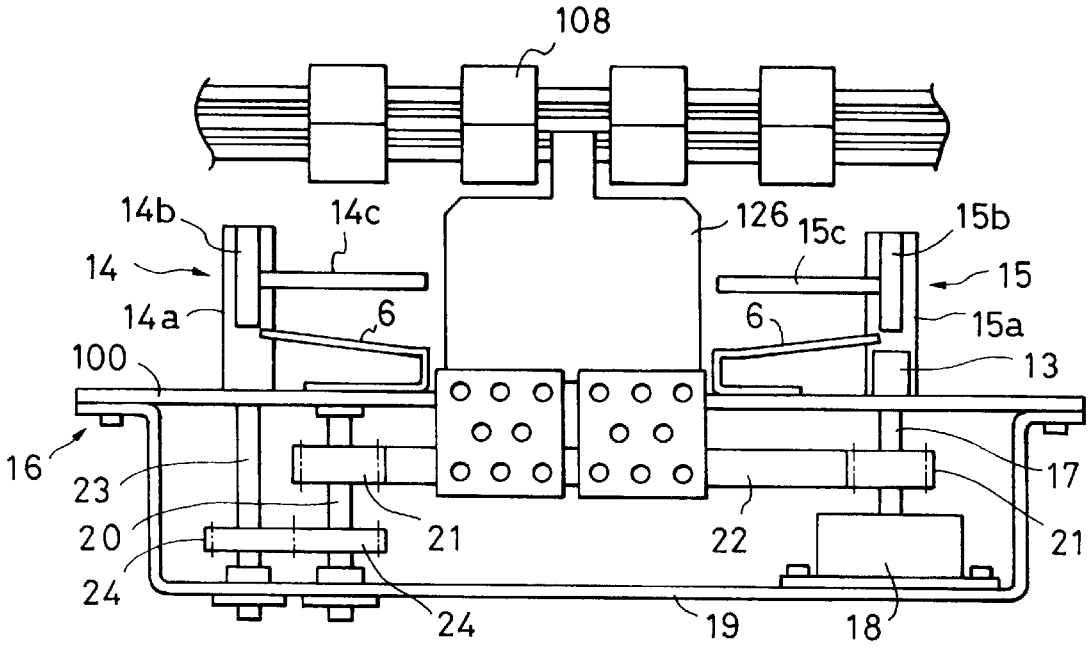
FIG. 21 is a sectional view taken along line XXI—XXI in FIG. 19.
Figure 22:
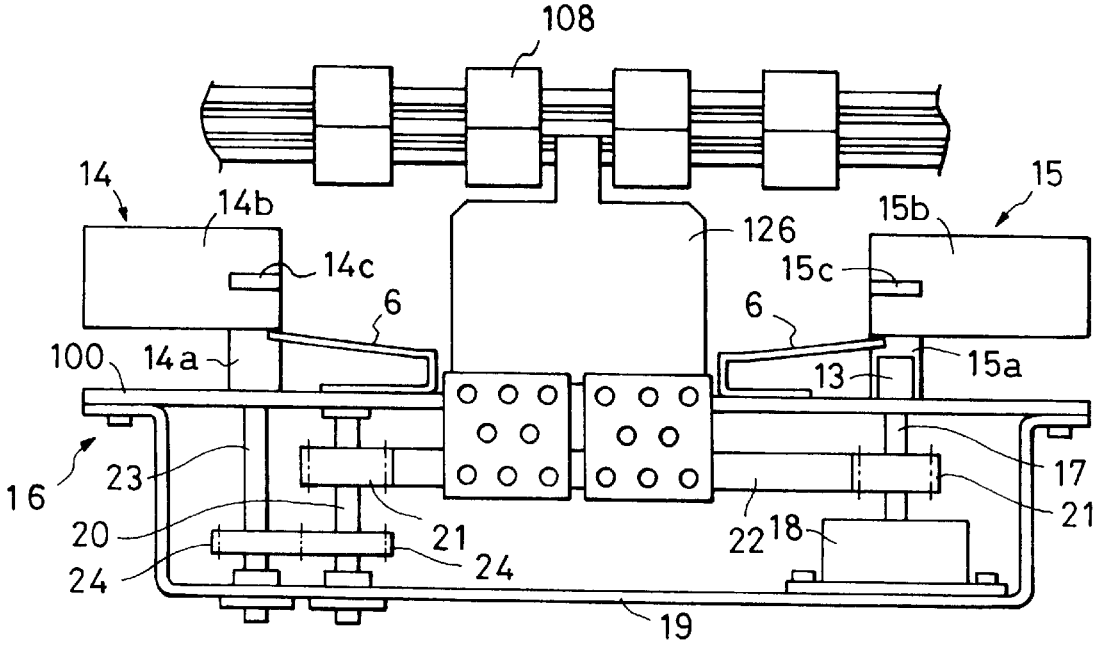
FIG. 22 is a sectional view taken along line XXII—XXII in FIG. 20.
Figure 23:
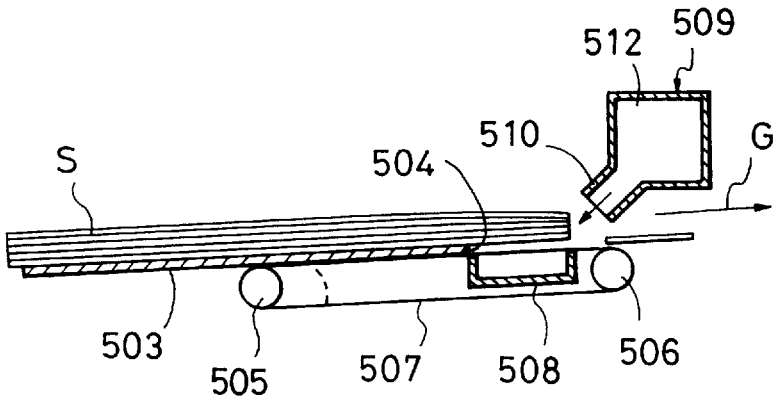
FIG. 23 PRIOR ART
FIG. 23 is a sectional side view illustrating a conventional feeding device.
Figure 24:
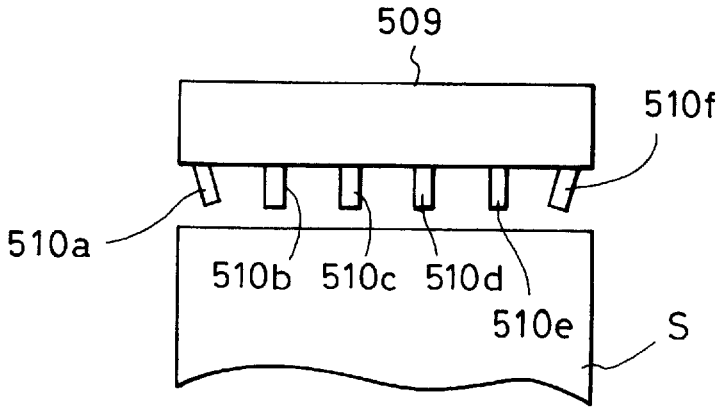
FIG. 24 PRIOR ART
FIG. 24 is a plan view illustrating the conventional feeding device.
Figure 25:
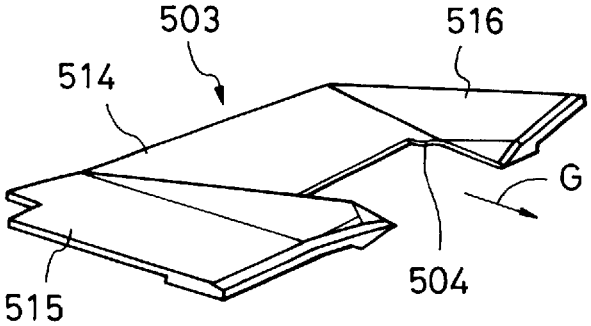
FIG. 25 PRIOR ART
FIG. 25 is a perspective view illustrating a supporting tray of a conventional feeding device.
Figure 26:
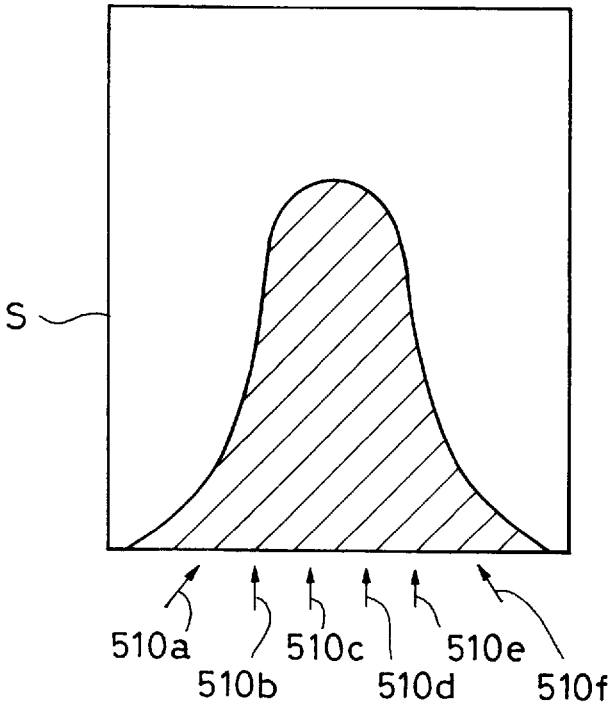
FIG. 26 PRIOR ART
FIG. 26 is a view illustrating the distribution of an air flow in a conventional feeding device.

FIG. 18 is a longitudinal sectional side view of the double-side unit 2, FIGS. 19 and 20 are plan views of the double-side unit 2, FIG. 21 is a sectional view taken along line XXI—XXI in FIG. 19, and FIG. 22 is a sectional view taken along line XXII—XXII in FIG. 20. The same parts as those in the second embodiment are denoted by the same reference numerals and are not described below.

In FIG. 20, reference numerals 14 and 15 respectively denote side regulating units for regulating the sheets loaded in the double-side unit 2 in the widthwise direction thereof. The side regulating units 14 and 15 are provided at two positions of the sheet tray 100 in the widthwise direction of the sheets.

The side regulating unit 14 comprises a side regulating plate 14*b* having a base fixed to a ring 14*a*, and a sheet supporting member 14*c* which is inclined inwardly (toward the center of the sheet tray 100) with respect to the side regulating plate 14*b*. The side regulating plate 14*b* and the sheet supporting member 14*c* are integrally formed. The other side regulating unit 15 has the same structure comprising a side regulating plate 15*b* having a base fixed to a ring 15*a*, and a sheet supporting member 15*b*, both of which are integrally formed.

A shield portion 15*b* is provided at the free end of the side regulating plate 15*b* so as to be detected by a side regulating plate sensor 13 when the side regulating plate 15*b* is at a side regulation position.

Driving shafts 23 and 17 to which the rings 14*a* and 15*a* are respectively fixed are provided on the sheet tray so that they are rotated in linkage with each other, as described below.

Means for driving the side regulating units 14 and 15 is described below.

In FIG. 21 and 22, reference numeral 18 denotes a stepping motor (regulating unit driving means) for driving the side regulating units 14 and 15. The stepping motor 18 is fixed to a drive stay 19 which is fixed to both ends of the sheet tray 100. The driving shaft 17 of the stepping motor 18 is common to the side regulating unit 15 so that driving of the stepping motor 18 is transmitted directly to the side regulating unit 15.

A timing belt 22 is wound on timing pulleys 21 to which the driving shaft 17 and a support shaft 20 are respectively fixed so as to transmit rotation of the driving shaft 17 to the support shaft 20. The support shaft 20 is rotatably mounted on the sheet tray 100 and the drive stay 19. Gears 24 which are respectively fixed to the support shaft 20 and the driving shaft 23 are engaged to each other so as to reverse rotation of the support shaft 20 and transmit it to the driving shaft 23.

The driving shaft 17, the timing pulleys 21, the timing belt 22, the driving shaft 23, the gears 24, etc. form drive transmitting means (linkage mechanism) for transmitting drive of the stepping motor 18 to the side regulating units 14 and 15.

When the stepping motor 18 is rotated in the above-mentioned manner, the side regulating units 14 and 15 are rotated in linkage with each other. In normal rotation of the stepping motor 18, the side regulating plates 14*b* and 15*b* are moved to the side regulation position, and the sheet supporting members 14*c* and 15*c* are moved to the working position where sheets S are supported (refer to FIG. 19). In reverse rotation of the stepping motor 18, the side regulating units 14 and 15 are moved to the retracted position shown in FIG. 20 from the working position shown in FIG. 19.

The operation of the side regulating units 14 and 15 is described below.

When a large number (for example, maximum loadable number=N) of large-size sheets S are loaded, the side regulating units 14 and 15 are retracted at the both sides of the sheet tray 100, as shown in FIGS. 18 and 20.

In this state, for example, when N/2 large-size sheets S are completely loaded on the sheet tray 100, the controller 30, which may serve as a drive control means, controls the stepping motor 18 to normally rotate it. Normal rotation of the stepping motor 18 causes the side regulating units 14 and 15 to be rotated to the working positions shown in FIG. 19 in linkage with each other. When the shield portion 15*d* of the side regulating unit 15 shields light from the side regulating plate sensor 13, the stepping motor is stopped.

In FIG. 19, the both sides of the sheets are regulated by the side regulating plates 14*b* and 15*b* of the side regulating units 14 and 15 at a distance slightly larger than the width of the sheets. The sheet supporting members 14*c* and 15*c* are projected to the working positions so as to support sheets S succeeding the N/2 sheets.

The remaining N/2 sheets S are loaded on the sheet tray 100 with the trailing ends of the sheets being supported by the sheet supporting members 14*c* and 15*c* (FIG. 18). Then, when normal and reverse rotations of the stepping motor 18 are repeated, the side regulating plates 14*b* and 15*b* of the side regulating units 14 and 15 adjust the loaded sheets S in the widthwise direction thereof.

The sheets S loaded on the sheet stray 100 as shown in FIG. 18 are then separated one by one by the same separating operation as in the second embodiment, and conveyed to the outside of the double-side unit 2.

When all sheets S in the double-side unit 2 are completely separated and conveyed, the stepping motor makes a predetermined number of reverse rotations, and the side regulating units 14 and 15 are retracted for the next loading (refer to FIG. 20)

Loading of a small number of large-size sheets S, e.g., the number of the sheets loaded M satisfies the relation M<N/2, and loading of small-size sheets S are respectively performed by the same operations as cases (2) and (3) in the second embodiment. In these cases, the trailing ends of the sheets are not supported by the sheet supporting members 14*c* and 15*c*.

In the second and third embodiments, the number or size of the sheets loaded, whose trailing ends are to be supported by the sheet supporting members, and the number of the sheets loaded for which the sheet supporting members are operated, are not limited to half (N/2) of the maximum loadable number N, and they may be appropriately selected.

The sheet supporting members need not be formed integrally with the side regulating plates, and may be formed separately therefrom.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet feeding device comprising:

sheet supporting means for supporting sheets;

sheet feeding means for feeding the sheets supported by said sheet supporting means, said sheet feeding means including attraction means for attracting a sheet to said sheet feeding means by air suction; and air injection means for injecting air toward edges of the sheets for separating, one by one, the sheets supported by said sheet supporting means, wherein said air injection means comprises first air injection means for injecting air toward leading ends of the sheets supported by said sheet supporting means, and second air injection means disposed at a position on a side of the sheets supported by said sheet supporting means for injecting air from the side position toward a side edge of the sheets supported by said sheet supporting means, said second air injection means directing air toward the trailing ends of the sheet supported by said sheet supporting means, and wherein said sheet supporting means is configured for supporting sheets of plural sizes; and further comprises control means for controlling said first and second air injection means to both inject air when sheets of a size greater than a predetermined size are loaded on said sheet supporting means, and only said first air injection means to inject air when sheets of a size smaller than the predetermined size are loaded.

2. A sheet feeding device according to claim 1, wherein said second air injection means is disposed at a position corresponding to ½ of the maximum-size sheets among the sheets loaded on said sheet supporting means.

3. A sheet feeding device according to claim 1, wherein said sheet supporting means comprises side regulating means for regulating the side edges of the sheets supported thereon, and said second air injection means is provided on said side regulating means.

4. A sheet feeding device according to claim 3, wherein said side regulating means is moved in accordance with the size of the sheets supported, so as to be able to regulate the sheets.

5. A sheet feeding device according to claim 1, wherein said second air injection means is arranged so as to inject air at a predetermined angle toward the trailing ends of the sheets supported by said sheet supporting means.

6. A sheet feeding device according to claim 1, wherein said second air injection means is arranged so as to inject air at a predetermined angle with respect to a supporting surface of said sheet supporting means for supporting sheets.

7. A sheet feeding device according to claim 1, wherein said attraction means comprises a first suction chamber disposed on an upstream side of said attraction means in the feeding direction of sheets, a second suction chamber disposed on a downstream side; and said sheet feeding means comprises a conveyance belt moved while covering said first and second suction chambers, and having a plurality of suction holes formed therein, wherein a first holding surface formed by said first suction chamber and a second holding surface formed by said second suction chamber are connected at a predetermined angle.

8. A sheet feeding device according to claim 7, wherein said sheet supporting means has a sheet tray for supporting sheets, said sheet tray being formed at a predetermined angle so as to be substantially parallel to said first holding surface.

9. An image forming apparatus comprising:

sheet supporting means for supporting sheets;

sheet feeding means for feeding the sheets supported by said sheet supporting means, said sheet feeding means including attraction means for attracting a sheet to said sheet feeding means by air suction;

air injection means for injecting air toward edges of the sheets supported by said sheet supporting means, for separating the sheets one by one; and image forming means for forming an image on a sheet fed by said sheet feeding means;

wherein said air injection means comprises first air injection means for injecting air toward leading ends of the sheets supported by said sheet supporting means, and second air injection means disposed at a position on a side of the sheets supported by said sheet supporting means for injecting air from the side position toward side edges of the sheets supported by said sheet supporting means, said second air injection means directing air toward the trailing ends of the sheet supported by said sheet supporting means, and wherein said sheet supporting means is configured for supporting sheets of plural sizes; and further comprises control means for controlling said first and second air injection means to both inject air when sheets of a size greater than a predetermined size are loaded on said sheet supporting means, and only said first air injection means to inject air when sheets of a size smaller than the predetermined size are loaded.

10. A sheet feeding device comprising:

sheet supporting means for supporting sheets;

sheet feeding means for feeding the sheets supported by said sheet supporting means, said sheet feeding means including attraction means for attracting a sheet to said sheet feeding means by air suction; and air injection means for injecting air toward edges of the sheets for separating, one by one, the sheets supported by said sheet supporting means, wherein said air injection means comprises first air injection means for injecting air toward leading ends of the sheets supported by said sheet supporting means, and second air injection means disposed at a position on a side of the sheets supported by said sheet supporting means for injecting air from the side position toward a side edge of the sheets, wherein said sheet supporting means is configured for supporting sheets of plural sizes, and wherein said sheet feeding device further comprises control means for controlling said first and second air injection means to both inject air when sheets of a size greater than a predetermined size are loaded on said sheet supporting means, and only said first air injection means to inject air when sheets of a size smaller than the predetermined size are loaded.

11. A sheet feeding device according to claim 10, wherein said sheet supporting means comprises side regulating means for regulating the side edges of the sheets supported thereon, and said second air injection means is provided on said regulating means.

12. A sheet feeding device according to claim 11, wherein said side regulating means is moved in accordance with the size of the sheets supported on said sheet supporting means, so as to be able to regulate the sheets.

13. A sheet feeding device according to claim 10, wherein said second air injection means is arranged so as to inject air at a predetermined angle with respect to a supporting surface of said sheet supporting means for supporting sheets.

14. An image forming apparatus comprising:

sheet supporting means for supporting sheets;

image forming means for forming an image on the sheets supported by said sheet supporting means;

sheet feeding means for feeding the sheets supported by said sheet supporting means to said image forming means, said sheet feeding means including attraction means for attracting a sheet to said sheet feeding means by air suction; and air injection means for injecting air toward edges of the sheets for separating, one by one, the sheets supported by said sheet supporting means, wherein said air injection means comprises first air injection means for injecting air toward leading ends of the sheets supported by said sheet supporting means, and second air injection means disposed at a position on a side of the sheets supported by said sheet supporting means for injecting air from the side position toward a side edge of the sheets, wherein said sheet supporting means is configured for supporting sheets of plural sizes, and wherein said sheet feeding device further comprises control means for controlling said first and second air injection means to both inject air when sheets of a size greater than a predetermined size are loaded on said sheet supporting means, and only said first air injection means to inject air when sheets of a size smaller than the predetermined size are loaded.

* * * * *

UNITED STATES PATENT AND TRADEMARK OFFICE

CERTIFICATE OF CORRECTION

PATENT NO. : 5,836,582

DATED : November 17, 1998

INVENTOR(S) : HIROSHI OGAWA, ET AL.

It is certified that error appears in the above-identified patent and that said Letters Patent is hereby corrected as shown below:

COLUMN 7,
Line 22, "improve" should read --improved--.

COLUMN 12,
Line 64, "the" (first occurrence) should be deleted.

Signed and Sealed this

Thirteenth Day of July, 1999

*Attest:*

*Attesting Officer*

Q. TODD DICKINSON

*Acting Commissioner of Patents and Trademarks*